US011840826B1

(12) United States Patent
Nackers et al.

(10) Patent No.: US 11,840,826 B1
(45) Date of Patent: Dec. 12, 2023

(54) HYDRAULIC HEALTH SYSTEM

(71) Applicant: Caterpillar SARL, Geneva (CH)

(72) Inventors: Adam Martin Nackers, Washington, IL (US); Christopher Michael Ruemelin, Morton, IL (US); Steven D. Spencer, Germantown Hills, IL (US); Rustin Glenn Metzger, Carlock, IL (US)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 17/991,215

(22) Filed: Nov. 21, 2022

(51) Int. Cl.
*E02F 9/26* (2006.01)
*E02F 9/24* (2006.01)
*E02F 9/22* (2006.01)

(52) U.S. Cl.
CPC ..... *E02F 9/24* (2013.01); *E02F 9/2292* (2013.01); *E02F 9/2296* (2013.01); *E02F 9/265* (2013.01)

(58) Field of Classification Search
CPC ... E02F 9/24; E02F 9/267; E02F 9/226; E02F 9/265
See application file for complete search history.

(56) References Cited

U.S. PATENT DOCUMENTS

| | | | | |
|---|---|---|---|---|
| 6,493,616 | B1 | 12/2002 | Rossow et al. | |
| 9,725,886 | B2 * | 8/2017 | Sugiura | E02F 9/268 |
| 10,253,482 | B2 | 4/2019 | Funabiki et al. | |
| 10,633,828 | B2 | 4/2020 | Joo | |
| 10,858,810 | B2 * | 12/2020 | Tsukamoto | G07C 5/008 |
| 2017/0138018 | A1 * | 5/2017 | Beschorner | E02F 9/2296 |

* cited by examiner

*Primary Examiner* — Abiy Teka

(57) ABSTRACT

A system and method for determining a health status of a hydraulic system is disclosed. The system may comprise a controller configured to receive a request to determine a health status and in response to the request, automatically conduct a health test and determine the health status. The health test may include: move a member or the upper frame; receive information indicative of measurements associated with movement; determine one or more parameters; compare each parameter to a check range or value; and if the pump status, the main control valve leakage status, the in-line relief valve leakage status, the cylinder drift status or the cylinder seal leak status associated with the component is currently failing, predicted to fail or out of specification, identify the component as a service-needed on a display or log and activate an alarm.

18 Claims, 10 Drawing Sheets

HYDRAULIC HEALTH SYSTEM

TECHNICAL FIELD

The present disclosure generally relates to maintenance and service systems for hydraulic machines, and more particularly, maintenance and service systems for hydraulic excavators.

BACKGROUND

Hydraulic system components on machines can over time wear out or fail. Efficiency reductions caused by parts that are wearing out or failing can drive significant downtime and costs for machine owners/operators. Machines, especially heavy equipment, may require time intensive troubleshooting or analysis for after component fails. This can be aggravated if the service need occurs when the machine is in the field on a job or when service personnel are not readily available for troubleshooting, or service analysis for the machine.

U.S. Pat. No. 9,725,886, issued Aug. 8, 2017, discloses an abnormality control device for a construction machine that includes: an abnormality detection means for detecting abnormality of an apparatus installed on the construction machine. The abnormality information output means outputs abnormality information about the apparatus in certain modes, and avoids outputting the abnormality information about the apparatus detected in other modes. A mode switch means is disclosed for determining a content of maintenance work and switching a work mode between an ordinary mode and a work mode according to the content of work or a situation. A better system is desired for predicting component failure or worn parts.

SUMMARY OF THE DISCLOSURE

In one aspect of the present disclosure, a system for determining a health status of a hydraulic system disposed on a machine is disclosed. The machine may comprise a body and an attachment disposed on the body. The body may include a pivotable upper frame. The attachment may include one or more members. The system may comprise a controller. The controller may be configured to receive a request to determine a health status of a hydraulic system disposed on a machine, the hydraulic system including a plurality of components, the plurality of components including one or more hydraulic cylinders, one or more pumps, one or more valves, each pump in fluid communication with at least one hydraulic cylinder and/or at least one valve, at least one hydraulic cylinder coupled to and configured to actuate movement of at least one member disposed on the machine, the member comprising a boom, a stick or a bucket. The controller may be further configured to in response to the request, automatically conduct a health test and determine the health status. The health test may include: move the one or more members or the upper frame from a starting position to one or more test positions; receive information indicative of one or more measurements associated with movement of at least one member or the upper frame that result from the move; determine from the information one or more parameters, the one or more parameters including one or more pump flows at an output of the one or more pumps, one or more swing motor flows, one or more cylinder flows, one or more pump pressures at the one or more pumps, one or more hydraulic cylinder lengths, one or more hydraulic cylinder head end pressures, or one or more hydraulic cylinder rod end pressures; compare each parameter to an check range or value; determine for one or more components of the hydraulic system a pump volumetric efficiency, a pump status, a main control valve leakage status, an in-line relief valve leakage status, a cylinder drift status or a cylinder seal leak status; and if the pump status, the main control valve leakage status, the in-line relief valve leakage status, the cylinder drift status or the cylinder seal leak status associated with the component is currently failing, predicted to fail or out of specification, identify the component as a service-needed on a display or log and activate an alarm.

In another aspect of the disclosure, a method for determining a health status of a hydraulic system disposed on a machine. The machine may include a body and an attachment disposed on the body, the body including a pivotable upper frame, the attachment including one or more members. The method may comprise: receiving a request to determine a health status of a hydraulic system disposed on a machine, the hydraulic system including a plurality of components, the plurality of components including one or more hydraulic cylinders, one or more pumps, one or more valves, each pump in fluid communication with at least one hydraulic cylinder and/or at least one valve, at least one hydraulic cylinder coupled to and configured to actuate movement of at least one member disposed on the machine, the member comprising a boom, a stick or a bucket. The method may further comprise: in response to the request, automatically conducting a health test and determine the health status. The health test may include: moving the one or more members or the upper frame from a starting position to one or more test positions; receiving information indicative of one or more measurements associated with the moving; determining from the information one or more parameters, the one or more parameters including one or more pump flows, one or more swing flows, one or more cylinder flows, one or more pump pressures, one or more hydraulic cylinder lengths, one or more hydraulic cylinder head end pressures, or one or more hydraulic cylinder rod end pressures; comparing each parameter to a check range or value; determining for one or more components of the hydraulic system a pump volumetric efficiency, a pump status, a main control valve leakage status, an in-line relief valve leakage status, a cylinder drift status or a cylinder seal leak status; and if the pump status, the main control valve leakage status, the in-line relief valve leakage status, the cylinder drift status or the cylinder seal leak status associated with the component is currently failing, predicted to fail or out of specification, identifying the component as service-needed on an output member or activating an alarm of an output member.

In yet another aspect of the disclosure, a system for determining a health status, when a hydraulic fluid in the hydraulic system is above a temperature threshold, of a hydraulic system disposed on an excavator. The excavator may include a body and an attachment disposed on the body. The body may include a pivotable upper frame, the attachment including a boom, a stick and a bucket. The system may comprise a controller. The controller may be configured to: receive a request to determine a health status of the hydraulic system, the hydraulic system including a plurality of components, the plurality of components including a boom hydraulic cylinder, a stick hydraulic cylinder, a bucket hydraulic cylinder, a first pump, a second pump, one or more main control valves and/or in-line relief valves, wherein the first pump is in fluid communication with the boom hydraulic cylinder or bucket hydraulic cylinder, wherein the second pump is in fluid communication with a swing motor and the stick hydraulic cylinder, and each of the first and second pumps in fluid communication with at least one of the main control valve and/or in-line relief valve, the boom hydraulic cylinder coupled to and configured to actuate movement of the boom, the stick hydraulic cylinder coupled to and configured to actuate movement of the stick, the bucket hydraulic cylinder coupled to and configured to actuate movement of the bucket, the swing motor configured to actuate swinging of the upper frame. The controller may be further configured to in response to the request, automatically conduct a health test and determine the health status, the health test including: move the boom, stick or bucket from a starting position to one or more test positions; receive information indicative of one or more measurements associated with movement of the boom, stick, bucket or upper frame, determine from the information one or more parameters, the one or more parameters including one or more pump flows, one or more swing flows, one or more cylinder flows, one or more pump pressures, one or more hydraulic cylinder lengths, one or more cylinder head end pressures, or one or more cylinder rod end pressures; compare each parameter to a check range or value; determine for one or more components of the hydraulic system a volumetric efficiency, a pump status, a main control valve leakage status, an in-line relief valve leakage status, a cylinder drift status or a cylinder seal leak status; and if the pump status, the main control valve leakage status, the in-line relief valve leakage status, the cylinder drift status or the cylinder seal leak status associated with the component is currently failing, predicted to fail or out of specification, identify the component as a service-needed on a display or log and activate an alarm.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts, unless otherwise specified.

Figure 1:
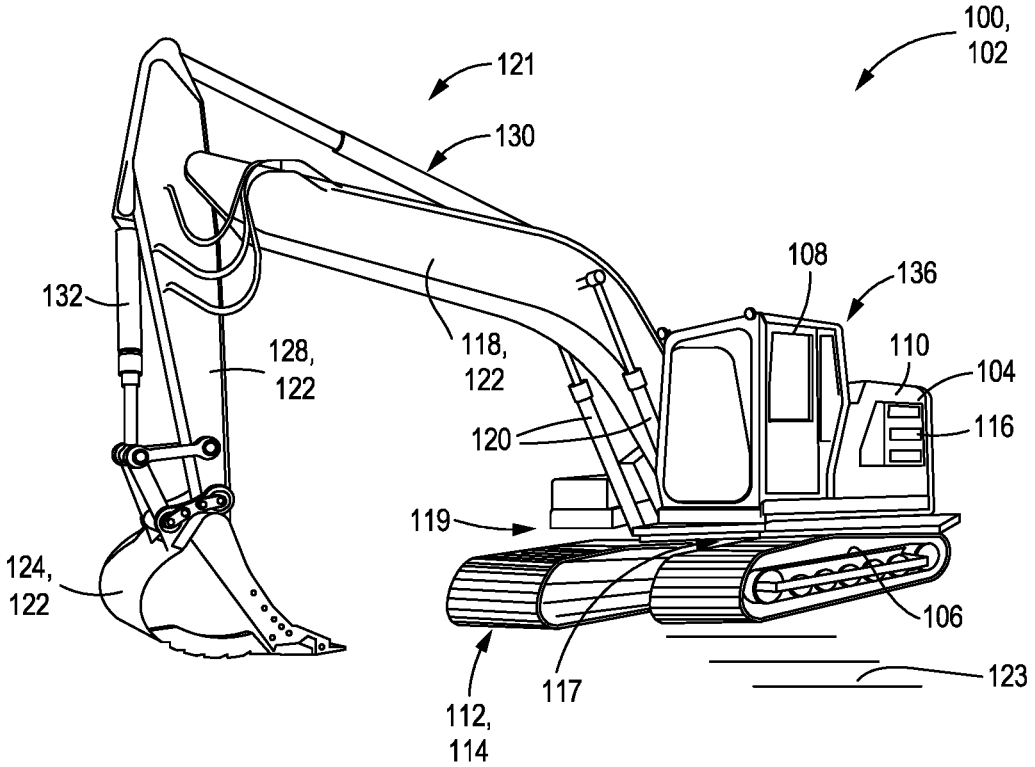
FIG. 1 is a perspective view of an exemplary machine that may include the system according to the present disclosure.

FIG. 1 illustrates one example of a machine 100 that may incorporate the features of the present disclosure. The exemplary machine 100 may be a vehicle such as an excavator 102. While the following detailed description and drawings are made with reference to an excavator 102 as the exemplary machine 100, the teachings of this disclosure may be employed on other machines 100, including, but not limited to, a backhoe loaders, hydraulic mining shovels or the like.

The excavator 102 may include an upper frame 104 rotationally connected to a lower frame 106. The upper frame 104 rotates/pivots in both the clockwise and the counterclockwise direction. A swing brake 117, when applied, may inhibit such rotation. The upper frame 104 includes an operator station 108 and a body 110. The lower frame 106 includes one or more ground engaging units 112. In the exemplary embodiment shown in FIG. 1, the ground engaging units 112 may be track assemblies 114. In alternative embodiments, the ground engaging units may be wheels or the like. One of ordinary skill in the art will appreciate that the machine 100 further includes a power source 116 (for example an engine), and a hydraulic system 119. The hydraulic system 119 may be powered by the power source 116.

The excavator 102 further includes an attachment 121 that comprises one or more members 122. In the exemplary embodiment of FIG. 1, the members 122 may comprise a boom 118 pivotably mounted on the body 110, a stick 128 pivotally connected to the boom 118 and a bucket 124 pivotally coupled to the stick 128. In other embodiments the bucket 124 may be replace with another tool.

The operator station 108 may be configured to house control levers, joysticks, push buttons, and other types of control elements typically known in the art for actuating an operation of the excavator 102, the ground engaging units 112, the boom 118, stick 128 and the bucket 124.

Figure 2:
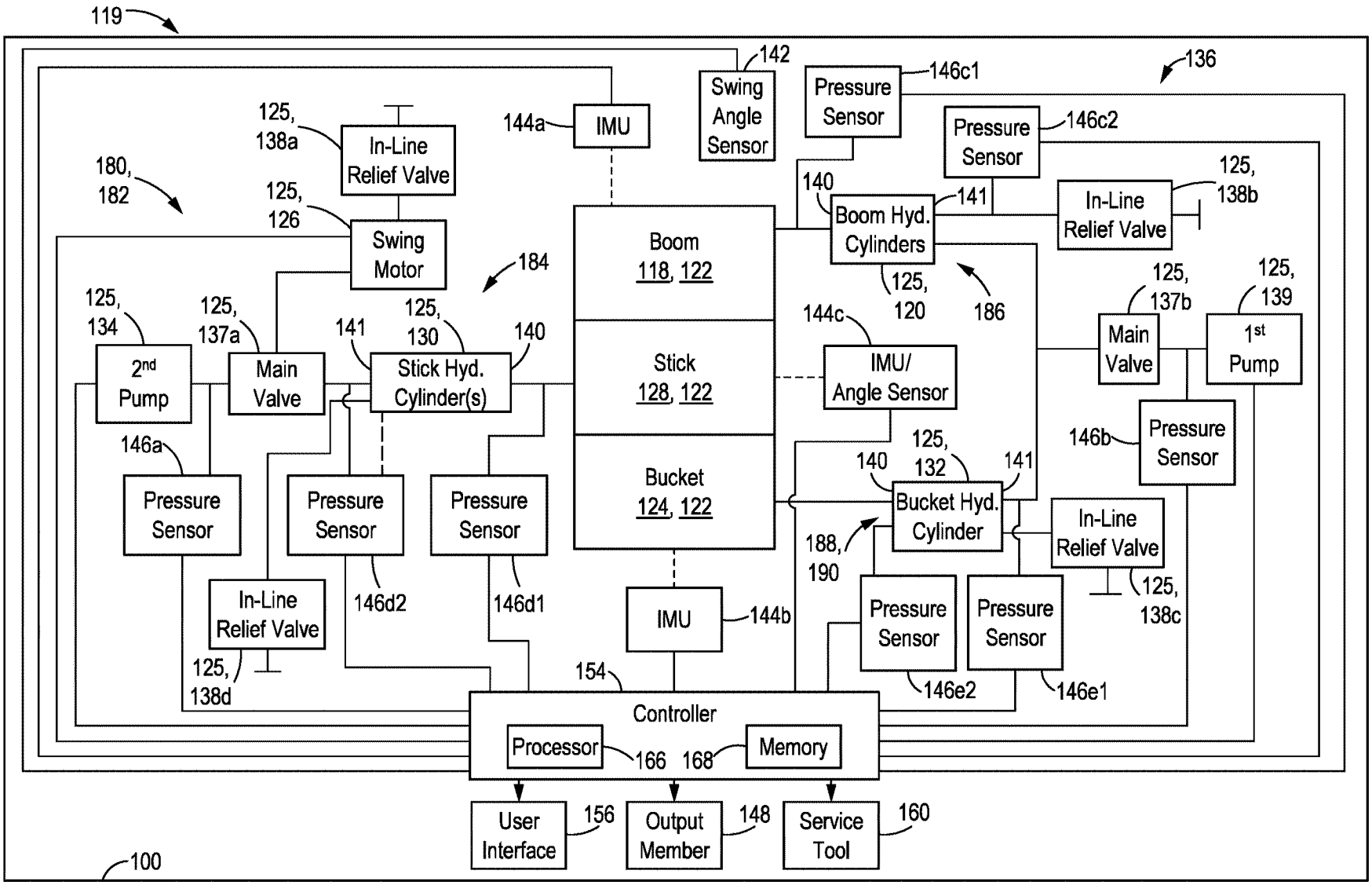
FIG. 2 is an exemplary block diagram of an embodiment of the system for use with the exemplary machine of FIG. 1.

The hydraulic system 119 may include a plurality of components 125 (FIG. 2). The plurality of components 125 may include a second pump 134, a first pump 139, boom hydraulic cylinders 120, a stick hydraulic cylinder 130, a bucket hydraulic cylinder 132, a swing motor 126, and one or more main control valves 137, and/or one or more in-line relief valves 138.

The second pump 134 is in fluid communication with the swing motor 126 and the stick hydraulic cylinder 130 and is configured to provided hydraulic fluid under pressure to the swing motor 126, and stick hydraulic cylinder 130. The second pump 134 in the exemplary embodiment is also in fluid communication with one or more main control valves 137*a* and/or in-line relief valves 138*a*.

The first pump 139 is in fluid communication with the boom hydraulic cylinders 120 and the bucket hydraulic cylinder 132 and is configured to provided hydraulic fluid under pressure to the boom hydraulic cylinders 120 and bucket hydraulic cylinder 132. The first pump 139 in the exemplary embodiment is also in fluid communication with one or more main control valves 137*b* and/or in-line relief valves 138*b*, 138*c*.

The swing motor 126 is configured to actuate swinging/pivoting movement of the upper frame 104 relative to the lower frame 106 both counterclockwise and clockwise.

The boom hydraulic cylinders 120 are each coupled to the boom 118 and configured to actuate movement (raising/lowering) of the boom 118 relative to the body 110. Each of the boom hydraulic cylinders 120 may be in fluid communication with the first pump 139 at the rod end 140 or head end 141 of the boom hydraulic cylinders 120. Each boom hydraulic cylinder 120 has a rod end 140 and a head end 141, as is known in the art.

The stick hydraulic cylinder 130 is coupled to the stick 128 and configured to actuate (pivoting inward/outward) movement of the stick 128 about the boom 118. The stick hydraulic cylinder 130 has a rod end 140 and a head end 141, as is known in the art.

The bucket hydraulic cylinder 132 is coupled to the bucket 124 and configured to actuate (pivoting) movement of the bucket 124 from a curl position to a dump position (curling or dumping movement) and vice versa. The bucket hydraulic cylinder 132 has a rod end 140 and a head end 141, as is known in the art.

The machine 100 may further include a system 136 for determining a health status of the hydraulic system 119. The hydraulic system 119 may include a plurality of circuits. In the simplified exemplary hydraulic system 119 shown in FIG. 2, the hydraulic system 119 may comprise a left-swing circuit 180, a right-swing circuit 182, a stick circuit 184, a boom-up circuit 186, a bucket-curl circuit 188 and a bucket-dump circuit 190. Each of these circuits are a portion of the hydraulic system 119. The hydraulic system 119 may comprise more than these circuits. The system 136 may be disposed on the machine 100 or may be disposed remotely from the machine 100.

The system 136 may include a swing angle sensor 142, a plurality of inertial measurement unit (IMU) sensors 144 (e.g., in the exemplary embodiment, a first IMU 144*a*, a second IMU 144*b*, a third IMU or angle sensor 144*c*), a plurality of pressure sensors 146, (e.g., in the exemplary embodiment, a first pressure sensor 146*a* configured to measure pressure at the output of the second pump 134, a second pressure sensor 146*b* configured to measure pressure at the output of the first pump 139, a rod-end boom-cylinder pressure sensor 146*c*1 configured to measure pressure at the rod end 140 of the boom hydraulic cylinder 120, a head-end boom-cylinder pressure sensor 146*c*2 configured to measure pressure at the head end 141 of the boom hydraulic cylinder 120, a rod-end stick-cylinder pressure sensor 146*d*1 configured to measure pressure at the rod-end 140 of the stick hydraulic cylinder 130, a head-end stick-cylinder pressure sensor 146*d*2 configured to measure pressure at the head-end 141 of the stick hydraulic cylinder 130, a head-end bucket-cylinder pressure sensor 146*e*1 configured to measure pressure at the head-end 141 of the bucket hydraulic cylinder 132, a rod-end bucket-cylinder pressure sensor 146*e*2 configured to measure pressure at the rod-end 140 of the bucket hydraulic cylinder 132, one or more output members 148, a controller 154 and a user interface 156. In some embodiments, the system 136 may further include a service tool 160.

The swing angle sensor 142 is configured to measure the relative angle between upper and lower frame 104, 106. The swing angle sensor 142 is in communication with the controller 154. The swing angle sensor 142 may be disposed on the machine 100.

The first pressure sensor 146*a* is disposed on the machine 100 and configured to measure pressure at the output of the second pump 134. The first pressure sensor 146*a* is in communication with the controller 154.

The second pressure sensor 146*b* is disposed on the machine 100 and is configured to measure pressure at the output of the first pump 139. The second pressure sensor 146*b* is in communication with the controller 154.

The first IMU sensor 144*a* is configured to measure the boom acceleration and/or the boom angular velocity during motion of the boom 118. The first IMU sensor 144*a* is in communication with the controller 154. The first IMU sensor 144*a* may be disposed on the machine 100. IMU 144*a* may be further configured to provided data indicative of boom hydraulic cylinder length to the controller 154.

The second IMU sensor 144*b* is configured to measure the bucket acceleration and/or the bucket angular velocity during motion of the bucket 124. The second IMU sensor 144*b* is in communication with the controller 154. The second IMU sensor 144*b* may be disposed on the machine 100. IMU 144*b* may be further configured to provided data indicative of bucket hydraulic cylinder length to the controller 154.

The third IMU/angle sensor 144*c* is configured to measure the stick acceleration and/or the stick angular velocity during motion of the stick 128. The third IMU/angle sensor 144*c* is in communication with the controller 154. The third IMU/angle sensor 144*c* may be disposed on the machine 100. IMU 144*c* may be further configured to provided data indicative of stick hydraulic cylinder length to the controller 154.

The rod-end boom-cylinder pressure sensor 146*c*1 may be disposed on the machine 100 and may be configured to measure the hydraulic fluid pressure at the rod-end 140 of the boom hydraulic cylinder 120. The rod-end boom-cylinder pressure sensor 146*c*1 is in communication with the controller 154. The head-end boom-cylinder pressure sensor 146*c*2 may be disposed on the machine 100 and may be configured to measure pressure at the head end 141 of the boom hydraulic cylinder 120. The head-end boom-cylinder pressure sensor 146*c*2 is in communication with the controller 154.

The rod-end stick-cylinder pressure sensor 146*d*1 may be disposed on the machine and is configured to measure the hydraulic fluid pressure at the rod-end 140 of the stick hydraulic cylinder 130. The rod-end stick-cylinder pressure sensor 146*d*1 is in communication with the controller 154. The head-end stick-cylinder pressure sensor 146*d*2 may be disposed on the machine and is configured to measure the hydraulic fluid pressure at the head-end 141 of the stick hydraulic cylinder 130. The head-end stick-cylinder pressure sensor 146*d*2 is in communication with the controller 154.

The head-end bucket-cylinder pressure sensor 146*e*1 may be disposed on the machine 100 and is configured to measure the hydraulic fluid pressure at the head-end 141 of the bucket hydraulic cylinder 132. The head-end bucket-cylinder pressure sensor 146*e*1 is in communication with the controller 154. The rod-end bucket-cylinder pressure sensor 146*e*2 may be disposed on the machine 100 and is configured to measure pressure at the rod-end 140 of the bucket hydraulic cylinder 132. The rod-end bucket-cylinder pressure sensor 146*e*2 is in communication with the controller 154.

The main control valves 137*a*, 137*b* may each be a control valve configured to regulate the flow of hydraulic fluid in a portion of a hydraulic system 119, as known in the art. In hydraulic systems 119, they may be configured to allow fluid to flow through or block fluid from flowing through. Each main control valve 137 may include a main relief valve and one or more spools. As is known in the art, the one or more spools may configured to divert flow to a desired hydraulic circuit. Such main relief valve may be configured to relieve pressure when such pressure exceeds a certain magnitude. In an embodiment, the main relief valve may be disposed on the pump inlets.

The in-line relief valves 138*a*, 138*b*, 138*c*, 138*d* may be a valve configured to limit fluid pressure in the part of the hydraulic system 119 in which installed, as is known in the art.

The controller 154 is in operable communication with the second pump 134, the first pump 139, one or more main control valves 137, one or more in-line relief valves 138, swing angle sensor 142, the plurality of inertial measurement unit (IMU) sensors 144 (e.g., in the exemplary embodiment, the first IMU 144*a*, the second IMU 144*b*, the third IMU/angle sensor 144*c*, the plurality of pressure sensors 146*a*, 146*b*, 146*c*1, 146*c*2, 146*d*1, 146*d*2, 146*e*1, 146*e*2, the one or more output members 140, the user interface 156 and the service tool 160.

The user interface 156 may be configured to receive input from a user and/or output results associated with the one or more health tests. The user interface 156 may be configured to transmit a request to determine a health status of the hydraulic system 119 to the controller 154, and may be disposed on the machine 100 (e.g., in the operator station 108) or may be disposed remote from the machine 100 (e.g. a mobile phone, a tablet, a computer, or the like).

The output member 148 may include, but is not limited to, a visual display, a log, a horn, flashing lights, buzzer or the like. The output member 148 may be configured to emit an audible alarm, and/or display a visual warning via a display screen, flashing lights, etc. when activated by the controller 154.

Sometimes maintenance or service personnel may connect a portable service tool 160 to the controller 154 while servicing, troubleshooting or calibrating a machine 100 that is in a factory, repair shop or service shop, at a dealership, or in the field. Such service tool 160 may be configured to receive input from a user and/or output results associated with the one or more health tests. The service tool 160 is also configured to transmit a request to determine a health status of the hydraulic system 119 to the controller 154.

The controller 154 may include a processor 166 and a memory component 168. The controller 154 is in operable communication with the hydraulic system 119 and with the system 136 for determining a health status.

The controller 154 may be configured to receive a request to determine a health status of the hydraulic system 119 from the user interface 156 or service tool 160.

The controller 154 may be further configured to also activate the display of a visual warning and/or emission of an audible alarm/alert by the output member 140 when a component 125 is failing, predicted to fail or out of specification. The controller 154 may be configured to display on the user interface 156 or service tool 160 results of the health tests (e.g., Pump Health Test, Stall Health Test, Drift Health Test, Seal Leak Health Test).

The processor 166 may be a microcontroller, a digital signal processor (DSP), an electronic control module (ECM), an electronic control unit (ECU), a microprocessor or any other suitable processor 166 as known in the art. The processor 166 may execute instructions and generate control signals for determining a pump volumetric efficiency, a pump status, a main control valve leakage status, an in-line relief valve leakage status, a cylinder seal leak status, or displaying a visual warning and/or emitting an audible alarm. The processor 166 may access check values or ranges in look-up tables or the like stored in the memory component 168 to assist with the determination of a pump status, a main control valve leakage status, an in-line relief valve leakage status, a cylinder seal leak status. Such instructions may be read into or incorporated into a computer readable medium, such as the memory component 168 or provided external to the processor 166. In alternative embodiments, hard wired circuitry may be used in place of, or in combination with, software instructions to implement a control method.

The term "computer readable medium" as used herein refers to any non-transitory medium or combination of media that participates in providing instructions to the processor 166 for execution. Such a medium may comprise all computer readable media except for a transitory, propagating signal. Common forms of computer-readable media include, for example, a floppy disk, a flexible disk, hard disk, magnetic tape, or any other magnetic medium, a CD-ROM, any other optical medium, or any other computer readable medium.

The controller 154 is not limited to one processor 166 and memory component 168. The controller 154 may include several processors 166 and memory components 168. In an embodiment, the processors 166 may be parallel processors that have access to a shared memory component(s) 168. In another embodiment, the processors 166 may be part of a distributed computing system in which a processor 166 (and its associated memory component 168) may be located remotely from one or more other processor(s) 166 (and associated memory components 168) that are part of the distributed computing system. The controller 154 may also be configured to retrieve from the memory component 168 data necessary for the actions discussed herein.

Also disclosed is a method for determining a health status of a hydraulic system 119 disposed on a machine 100. The machine 100 may include a body 110 and an attachment 121 disposed on the body 110, the body including a pivotable upper frame 104, the attachment 121 including one or more members 122. In an embodiment the method may comprise: receiving a request to determine a health status of a hydraulic system 119 disposed on a machine 100, the hydraulic system 119 including a plurality of components 125, the plurality of components 125 including one or more hydraulic cylinders 120, 130, 132 one or more pumps 134, 139, one or more valves 137, 138, each pump 134, 139 in fluid communication with at least one hydraulic cylinder 120, 130, 132 and/or at least one valve 137, 138, at least one pump in fluid communication with a swing motor 126, at least one hydraulic cylinder 120, 130, 132 coupled to and configured to actuate movement of at least one member 122 disposed on the machine 100, the member 122 comprising a boom 118, a stick 128 or a bucket 124; in response to the request, automatically conducting a health test and determine the health status, the health test including: moving the one or more members 122 or the upper frame 104 from a starting position to one or more test positions; receiving information indicative of one or more measurements associated with the moving; determining from the information one or more parameters, the one or more parameters including one or more pump flows, one or more swing motor flows, one or more hydraulic cylinder flows, one or more pump pressures, one or more hydraulic cylinder lengths, one or more hydraulic cylinder head-end pressures, or one or more hydraulic cylinder rod-end pressures; comparing each parameter to a check range or value; determining for one or more components 125 of the hydraulic system 119 a pump volumetric efficiency, a pump status, a main control valve leakage status, an in-line relief valve leakage status, a cylinder drift status or a cylinder seal leak status; and if the pump status, the main control valve leakage status, the in-line relief valve leakage status, the cylinder drift status or the cylinder seal leak status for the component 125 is currently failing, predicted to fail or out of specification, identifying the component 125 as a service-needed via a output member.

INDUSTRIAL APPLICABILITY

In general, the foregoing disclosure finds utility in machines 100 having with hydraulic systems 136 (e.g., implement, swing, travel circuits or the like). The teachings of this disclosure enable autonomous cycling of the machine 100 through one or more health tests to determine for one or more components 125 of the hydraulic system 119 an efficiency and/or a status, and to identify if a component 125 is failing, predicted to fail or out of specification, and to display or generate an alarm or warning.

Figure 3:
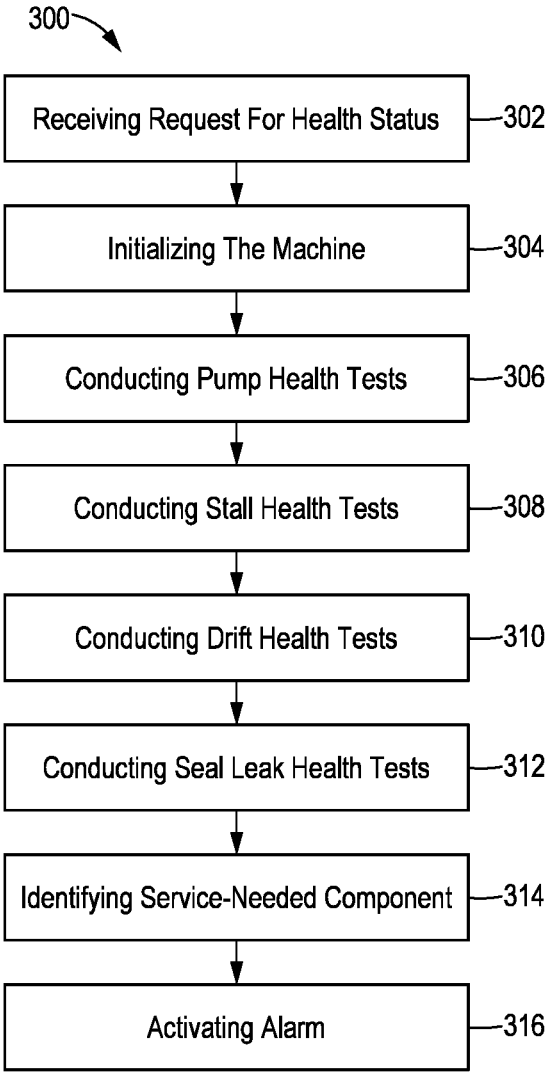
FIG. 3 is a block diagram of one exemplary method, according to the present disclosure.

In operation, the controller 154 may be configured to operate according to a predetermined method 300, as shown for example in FIG. 3 and methods 400-700 as shown in FIGS. 4-7. As used in this disclosure herein, unless stated otherwise, the term "check value" encompasses a single value or a range.

FIG. 3 is an exemplary flowchart illustrating sample blocks which may be followed in a method 300 of determining a health status of a hydraulic system 119 disposed on a machine 100 that includes a body 110 and an attachment 121 disposed on the body 110, the attachment 121 including one or more members 122. The members 122 including the boom 118, stick 128 and bucket 124.

In block 302, the method 300 includes receiving by the controller 154, from an user interface 156 or a service tool 160, a request to determine a health status of the hydraulic system 119.

In block 304, the method 300 may further include initializing the machine 100, by the controller 154. The initializing may include determining whether the temperature of the hydraulic fluid in the hydraulic system 119 is above a threshold (e.g., 50° C.). If the temperature is below the threshold, the controller 154 may increase pump flow for the first pump 139 and/or second pump 134. The initializing may further include determining that the boom cylinder displacement, stick cylinder displacement, bucket cylinder displacement is within a predetermined range. As used in block 304 boom displacement means the stroke length of the boom hydraulic cylinders 120. As used herein stick displacement means the stroke length of the stick hydraulic cylinders 130. As used herein bucket displacement means the stroke length of the bucket hydraulic cylinders 132. Minimum displacement means the cylinder is fully retracted, maximum displacement means the cylinder is fully extended.

Figure 4:
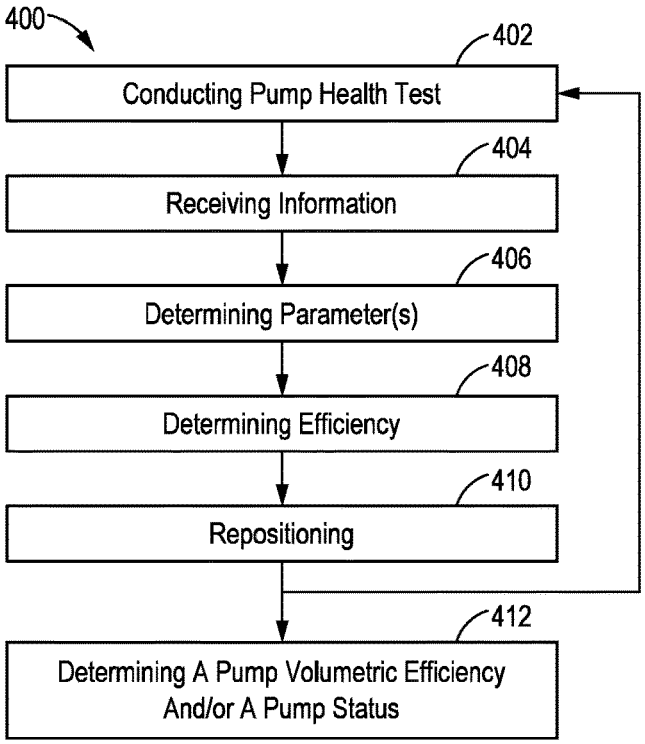
FIG. 4 is an exemplary block diagram of one exemplary method for the Pump Health Tests.

In block 306, method 300 further includes conducting one or more Pump Health Tests to determine pump volumetric efficiency and pump status for one or more pumps 134, 139 in a hydraulic system 119 or circuit thereof of a machine 100. FIG. 4 illustrates an exemplary embodiment of a method (labeled method 400) of conducting the Pump Health Tests for the exemplary machine 100 disclosed herein.

Figure 5A:
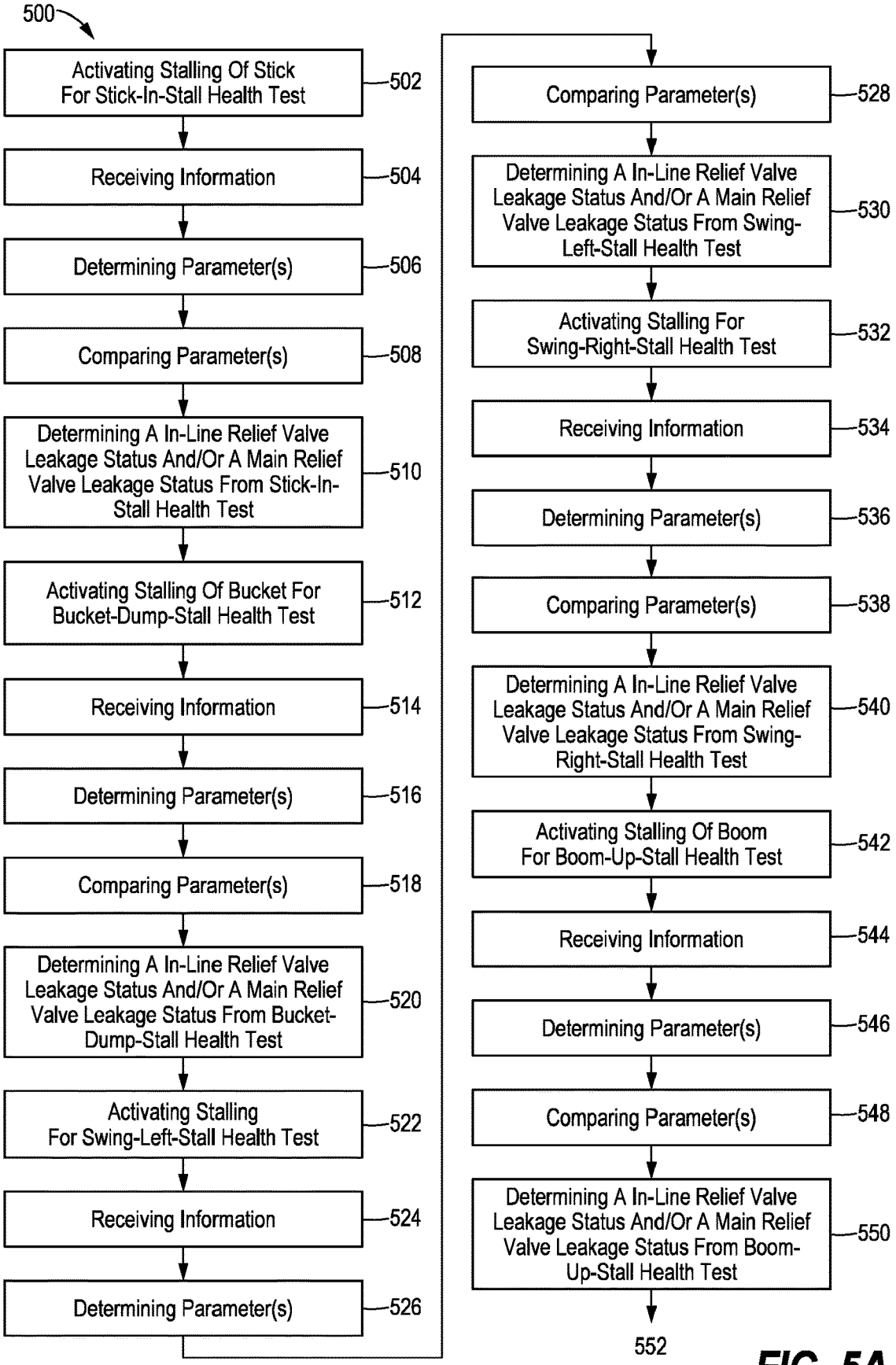
FIGS. 5A-B is an exemplary block diagram of one exemplary method for the Stall Health Tests.
Figure 5B:
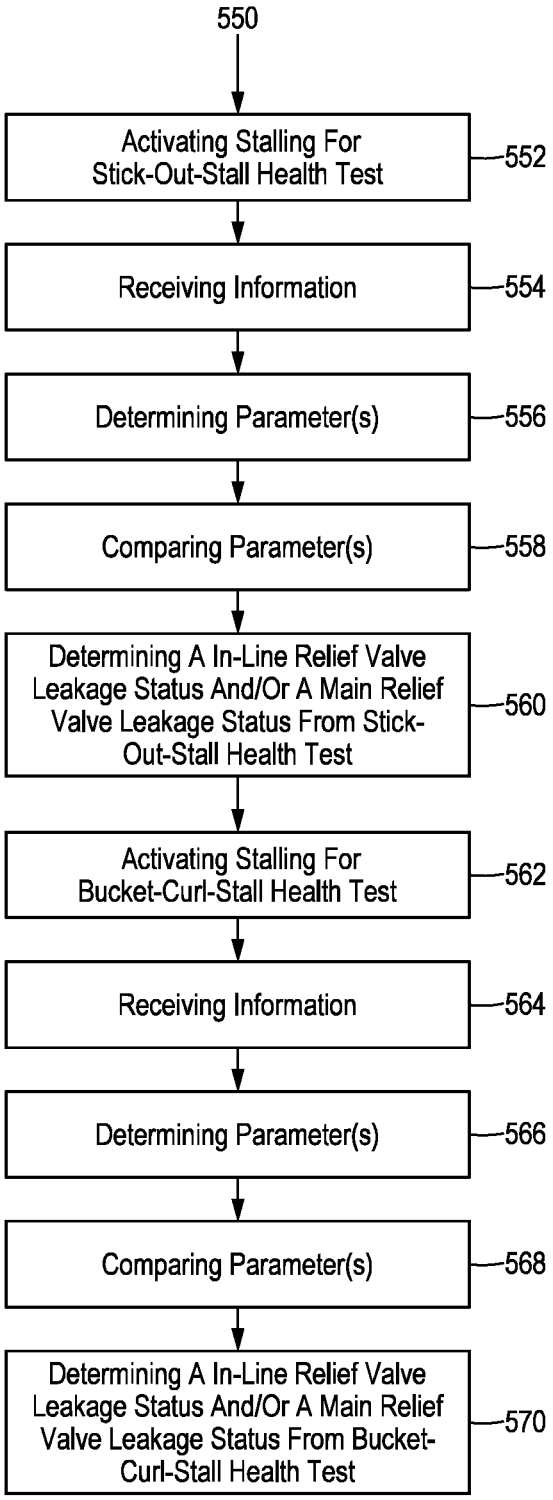

In block 308, method 300 further includes conducting one or more Stall Health Tests to determine the leakage status of one or more in-line relief valves 138 and/or main control valves 137 in the hydraulic system 119 or circuit thereof of the machine 100. FIGS. 5A-B illustrates an exemplary embodiment of a method (labeled method 500) of conducting the Stall Health Tests for the exemplary machine 100 disclosed herein.

Figure 6:
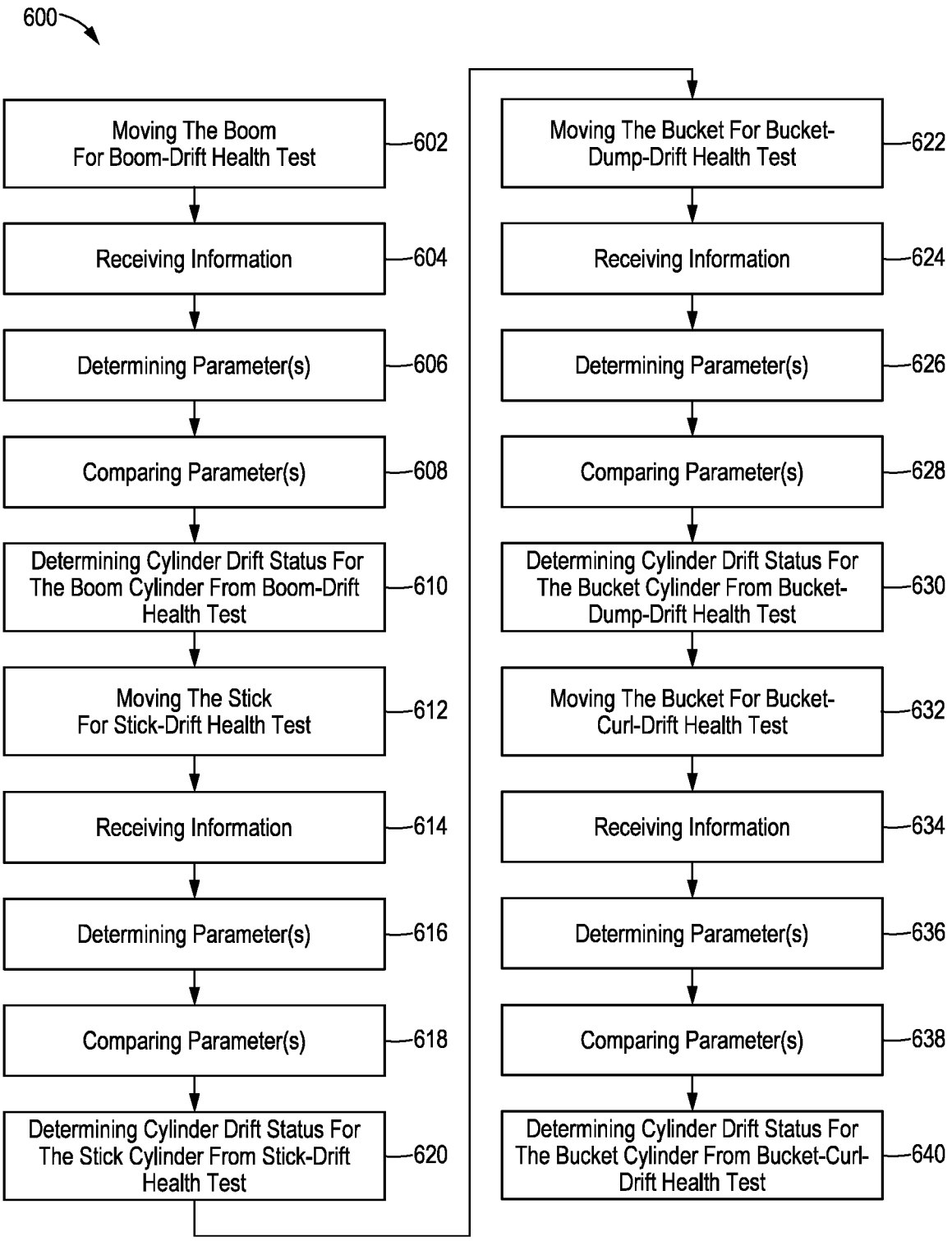
FIG. 6 is an exemplary block diagram of one exemplary method for the Drift Health Tests.

In block 310, method 300 further includes conducting one or more Drift Health Tests determine the cylinder drift status for one or more hydraulic cylinders (e.g., boom hydraulic cylinder 120, stick hydraulic cylinder 130, bucket hydraulic cylinder 132) in a hydraulic system 119 or circuit thereof of a machine 100. FIG. 6 illustrates an exemplary embodiment of a method (labeled method 600) of conducting the Drift Health Tests for the exemplary machine 100 disclosed herein.

Figure 7:
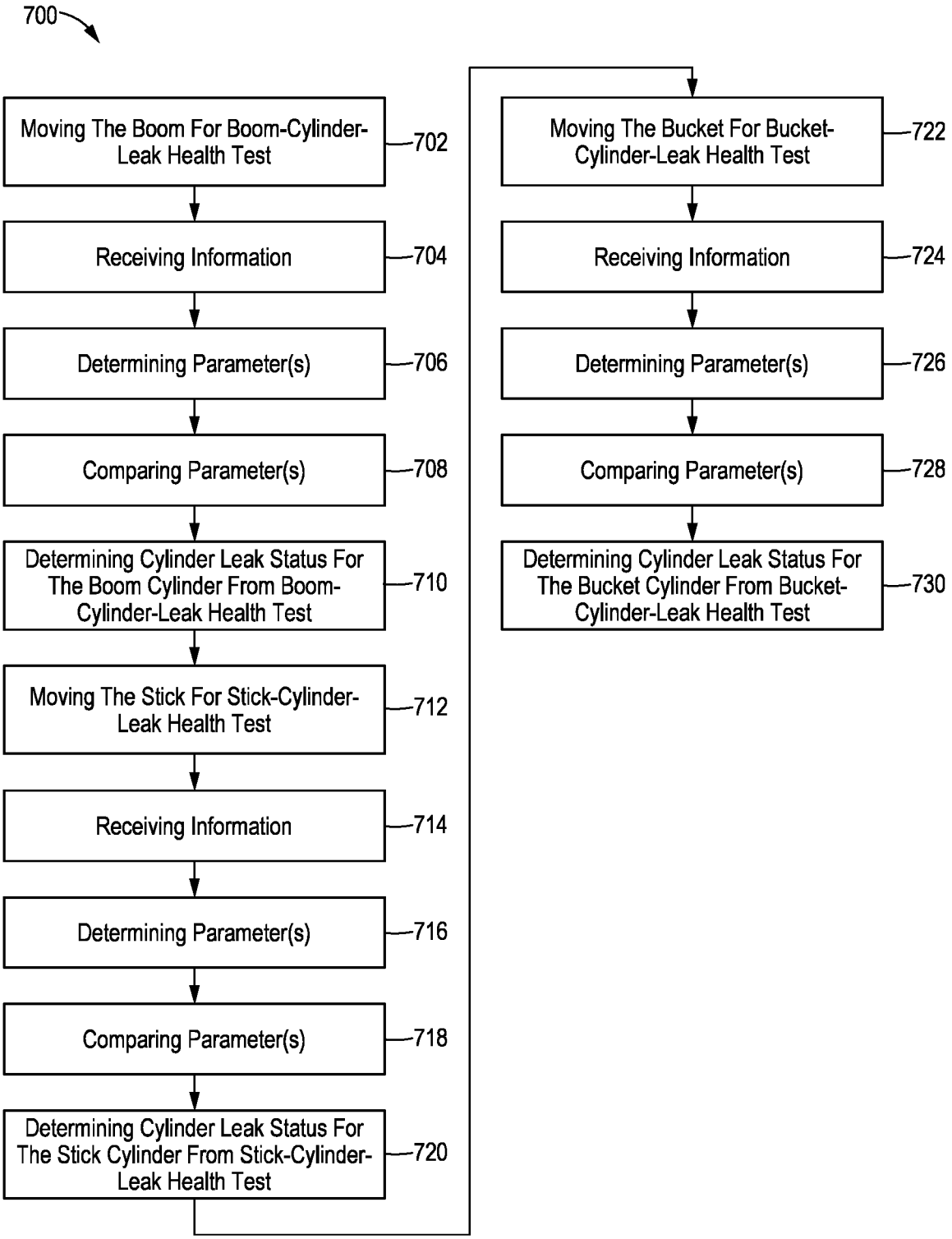
FIG. 7 is an exemplary block diagram of one exemplary method for the Seal Leak Health Tests.

In block 312, method 300 further includes conducting one or more Seal Leak Health Tests to determine the cylinder leak status for one or more hydraulic cylinders (e.g., boom hydraulic cylinder 120, stick hydraulic cylinder 130, bucket hydraulic cylinder 132) in a hydraulic system 119 or circuit thereof of a machine 100. FIG. 7 illustrates an exemplary embodiment of a method (labeled method 700) of conducting the Seal Leak Health Tests for the exemplary machine 100 disclosed herein.

In block 314, if the pump status, the main control valve leakage status, the in-line relief valve leakage status, the cylinder drift status or the cylinder leak status for a component 125 is currently failing, predicted to fail or out of specification, the method 300 further includes identifying the component 125 as a service-needed component. The identifying may include displaying data indicating that the component 125 is a service needed component on the user interface 156 or service tool 160 or logging the identification of the service-needed component. The identifying may also include displaying the pump volumetric efficiency of a pump (e.g., the second pump 134, the first pump 139) that is identified by the controller 154 as service-needed.

In block 316, method 300 may further include activating an alarm if a component 125 is a service-needed component. The activating of an alarm may include activating the display of a visual warning and/or emission of an audible alarm/alert by the output member 148.

FIG. 4 is an exemplary flowchart illustrating sample blocks which may be followed in method 400 of determining a health status of a hydraulic system 119 via conducting Pump Health Tests that determine pump volumetric efficiency and pump status for one or more pumps 134, 139 in the hydraulic system 119 or circuit thereof of the machine 100.

In block 402, the method 400 includes conducting a Pump Health Test for a machine hydraulic system 119 or circuit thereof (e.g., left-swing circuit 180, right-swing circuit 182, boom-up circuit 186, bucket-curl circuit 188, bucket-dump circuit 190, stick circuit 184).

In block 404, the method 400 further includes receiving, by the controller 154, information indicative of one or more measurements associated with the health test of block 402.

In block 406, the method 400 may further include determining, by the controller 154, one or more parameters from the information received in block 404.

In block 408, the method 400 may further include determining the volumetric efficiency for hydraulic circuit or system tested in block 402. The determining may include comparing each parameter of block 406 to a check range or to a check value.

In block 410, the method may optionally include repositioning the machine 100 (e.g., repositioning the upper frame 104 with respect to the lower frame 106) and or repositioning an attachment 121 or member 122 on the machine 100 to a test starting position. Blocks 402-410 may be repeated as desired.

In block 412, the method 400 may include determining a pump volumetric efficiency and/or a pump status based on the efficiency of one or more hydraulic circuits (e.g., left-swing circuit 180, right-swing circuit 182, boom-up circuit 186, bucket-curl circuit 188, bucket-dump circuit 190, stick circuit 184) or systems that are in fluid communication with the pump 134, 139. When based on a single circuit, the pump volumetric efficiency may be the same as the circuit efficiency. When based on a plurality of hydraulic circuits or systems, the pump volumetric efficiency may, in some embodiments, be an average of the volumetric efficiency of the plurality of circuits. The pump status may be categorized as failing, predicted to fail, out of specification or normal/passing. Over the lifetime of a pump 134, 139, the volumetric efficiency of a pump 134, 139 may degrade with use over time. The threshold check values or check ranges (failure threshold, predicted to fail range, out of specification range) may be based on historic efficiency values/ranges for a pump expected over a normal pump lifetime. The pump status may be "failing" when the determined volumetric efficiency for the pump is equal to or less than a failure threshold value. The pump status may be "predicted to fail" when the determined volumetric efficiency for the pump 134, 139 is in a predicted to fail range (typically a range that is above the failure threshold value but well below a normal/passing threshold value or range. The pump status may be "out of specification" when the determined volumetric efficiency for the pump 134, 139 is above the predicted to fail range but outside (too high or too low) of a normal/passing range. The pump status may be "normal" or "passing" when the volumetric efficiency for the pump 134, 139 is in a normal/passing range for the pump 134, 139.

Figure 4A:
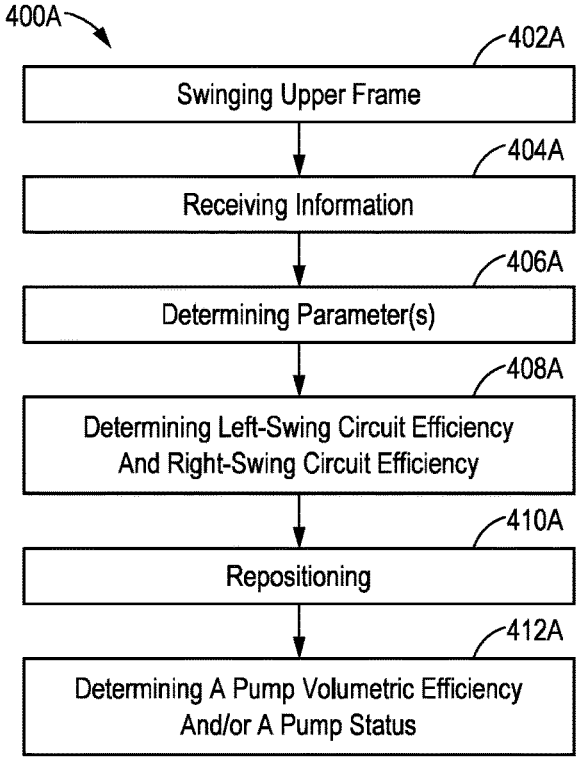
FIG. 4A is an exemplary block diagram illustrating an exemplary embodiment of the method of FIG. 4.

FIG. 4A illustrates one exemplary embodiment of method 400 for determining a pump volumetric efficiency and/or pump health status of an exemplary pump (e.g., in this case the second pump 134) that is in fluid communication with an exemplary hydraulic left-swing circuit 180 and right-swing circuit 182 in the machine 100. In the exemplary flowchart of FIG. 4A, block A402 corresponds to block 402 of FIG. 4, block A404 corresponds to block 404 (of FIG. 4), block A06 corresponds to block 406 (of FIG. 4), block A408 corresponds to block 408 (of FIG. 4), block A410 corresponds to block 410 of FIG. 4, and block A412 corresponds to block 412 of FIG. 4.

In block 402A, the method 400A includes swinging/pivoting the upper frame 104 relative to the lower frame 106 in a first direction from a starting position to a test position. The first direction may be counter-clockwise toward a left-side relative to the forward direction of travel of the machine 100, and may sometimes be referred to as the "left-swing circuit test." The method 400A may further include swinging/pivoting the upper frame 104 relative to the lower frame 106 in a second direction from a second starting position to a second test position. The second direction may be clockwise toward a right-side relative to the forward direction of travel of the machine 100, and may sometimes be referred to as the "right-swing circuit test".

In block 404A, the method 400A further includes receiving, by the controller 154, information indicative of one or more measurements associated with the swinging of the upper frame 104 in block 402A. The information may include a pump displacement command for the second pump 134, which is indicative of the output flow of hydraulic fluid ("pump flow") provided by such second pump 134 that is associated with the swinging of the upper frame 104 in the first direction from the starting position to the test position during the left-swing circuit test. The information may further include swing angle data received from the swing angle sensor 142 that is associated with the swinging of the upper frame 104 in the first direction from the starting position to the test position during the left-swing circuit test.

In block 404A, the method 400A further includes receiving, by the controller 154, information indicative of one or more measurements associated with the swinging of the upper frame 104 in block 402A during the right-swing circuit test. The information may include a pump displacement command for the second pump 134, which is indicative of the pump flow provided by the second pump 134 that is associated with the swinging of the upper frame 104 in the second direction from a starting position to a test position during the right-swing circuit test. The information may further include swing angle data received from the swing angle sensor 142 that is associated with the swinging of the upper frame 104 in the second direction from such starting position to such test position during the right-swing circuit test.

In block 406A, the method 400A may further include determining, by the controller 154, one or more parameters from the information. The one or more parameters may include a left-swing pump flow of the second pump 134 and a first swing motor flow during the swinging from the starting position to the test position during the left-swing circuit test. As is known in the art, the hydraulic fluid flow provided by a pump may be determined or estimated from the pump displacement command. As such, in an embodiment, the left-swing pump flow of the second pump 134 (hydraulic fluid flow provided by the second pump 134 for the "left-swing" of block 402A) may be determined from the pump displacement command for the second pump 134. The swing motor flow is the flow of hydraulic fluid provided by the second pump 134 that is used by the swing motor 126 to produce the swinging/pivoting motion at a given speed. The first swing angle data received from the swing angle sensor 142 is indicative of the swing speed of the upper frame 104 during the left-swing circuit test. As is known in the art, to determine the left-swing circuit efficiency, the controller 154 may determine the swing motor flow based on the swing speed (as determined from the data received from the swing angle sensor 142), the swing motor 126 size, and the gear reduction of the swing motor 126. The one or more parameters may further include a right-swing pump flow of the second pump 134 and a second swing motor flow during the swinging/pivoting from the starting position to the test position during the right-swing circuit test. As is known in the art, the right-swing pump flow of the second pump 134 (hydraulic fluid flow provided by the second pump 134 for the "right-swing" of block 402A) may be determined from the associated pump displacement command for the second pump 134. The swing angle data received from the swing angle sensor 142 is indicative of the swing speed of the upper frame 104 during the right-swing circuit test. To determine the right-swing circuit efficiency, the controller may determine the associated swing motor flow based on the swing speed during the right-swing circuit test (as determined from the data received from the swing angle sensor 142), the swing motor 126 size, and the gear reduction of the swing motor 126.

In block 408A, the method 400A may further include determining the left-swing circuit efficiency by comparing the swing motor flow (during the left-swing circuit test) to the left-swing pump flow that is based on the displacement command for the second pump 134. The method 400A may further include determining the right-swing circuit efficiency by comparing the swing motor flow (during the right-swing circuit test) to the right-swing pump flow that is based on the associated displacement command for the second pump 134. In some embodiments, the left-swing circuit efficiency may be determined as the ratio of the swing motor flow (during the left-swing) to the left-swing pump flow, and the right-swing circuit efficiency may be determined as the ratio of the swing motor flow (during the right-swing) to the right-swing pump flow.

In block 410A, the method may optionally include repositioning the machine 100 (e.g., repositioning the upper frame 104 with respect to the lower frame 106) to a test starting position. Blocks 402A-410A may be repeated as desired. In some embodiments, the controller 154 may cycle the machine 100 through the left-swing circuit test and right-swing circuit test of blocks 402A to 408A multiple times (e.g., three times) and determine an average left-swing circuit efficiency based on the plurality of the test cycles for the left-swing circuit test and determine an average right-swing circuit efficiency based on the plurality of the test cycles for the right-swing circuit test.

In block 412A, the method 400A may further include determining for the second pump 134 a pump volumetric efficiency and/or a pump status. In one embodiment, the volumetric efficiency for the second pump 134 may be determined as an average of the left-swing circuit efficiency and the right-swing circuit efficiency. The pump status may be "failing" when the determined volumetric efficiency for the second pump 134 is equal to or less than a failure threshold value. The pump status may be "predicted to fail" when the determined volumetric efficiency for the second pump 134 is in a predicted to fail range (typically a range that is above the failure threshold value but well below a normal/passing threshold value or range). The pump status may be "out of specification" when the determined volumetric efficiency for the second pump 134 is above the predicted to fail range but outside (too high or too low) of a normal/passing range. The pump status may be "normal" or "passing" when the volumetric efficiency for the second pump 134 is in a normal/passing range for the second pump 134.

In some embodiments, the volumetric efficiency for the second pump 134 may be determined as an average of the left-swing circuit efficiency and the right-swing circuit efficiency and the stick circuit efficiency. In such a case, the stick circuit efficiency may be determined according to blocks 402-410 of method 400. FIG. 4E illustrates an exemplary embodiment of blocks 402-410 of method 400 for determining the stick circuit efficiency of an exemplary hydraulic stick circuit 184 in the machine 100. In the exemplary flowchart of FIG. 4E, block 402E corresponds to block 402 of FIG. 4, block 404E corresponds to block 404, block 406E corresponds to block 406, block 408E corresponds to block 408, and block 410E corresponds to block 410 of FIG. 400.

In block 402E, the method 400E may further include moving the stick 128 from a starting position to a test position, and may sometimes be referred to as the "stick circuit test". An exemplary stick circuit test is discussed below.

In block 404E, the method 400E further includes receiving, by the controller 154, information indicative of one or more measurements associated with the moving of the stick 128 that result from block 402E. In the exemplary embodiment, the information may include a pump displacement command for the second pump 134, which is indicative of the pump flow provided by the second pump 134 that is associated with the moving of the stick 128 from the starting position to the test position during the stick circuit test. The information may further include a stick angular velocity that is associated with the moving of the stick 128 from the starting position to the test position. The stick angular velocity may be received from an IMU sensor 144*c*. The stick angular velocity received is indicative of the hydraulic fluid flow input to the stick hydraulic cylinder 130 (the "stick cylinder flow") that is associated with the moving of the stick 128 from the starting position to the test position of the stick circuit test.

In block 406E, the method 400E may further include determining (by the controller 154) one or more parameters based on the information. The one or more parameters may include a pump flow of the second pump 134 during the moving of the stick 128 to the test position (the "stick pump flow") and a stick cylinder flow for the stick 128 during the moving of the stick 128 to the test position. In an embodiment, the stick pump flow of the second pump 134 (hydraulic fluid flow provided by the second pump 134 for the "moving" of block 402E) may be determined from the pump displacement command for the second pump 134. The stick cylinder flow may also be calculated based on the stick angular velocity received from the IMU sensor 144*c*.

In block 408E, the method 400E may further include determining the stick circuit efficiency by comparing the ratio of the stick cylinder flow to the stick pump flow.

In block 410E, the method may optionally include repositioning the machine 100 (e.g., repositioning the stick 128) to a test starting position. Blocks 402E-410E may be repeated as desired. In some embodiments, the controller 154 may cycle the machine 100 through the stick circuit test of blocks 402E to 408E multiple times (e.g., three times) and determine an average stick circuit efficiency based on the plurality of the test cycles for the stick circuit test.

As discussed above, the pump volumetric efficiency and status for a pump may be based on one or more hydraulic circuit efficiencies. In another illustrative exemplary embodiment, the volumetric efficiency and status for the exemplary first pump 139 may be based on the average of the circuit efficiency for each of the boom-up circuit, the bucket-dump circuit and the bucket-curl circuit, as each may be determined according to blocks 402-410 of method 400 (see exemplary FIGS. 4B-4D below).

Figure 4B:
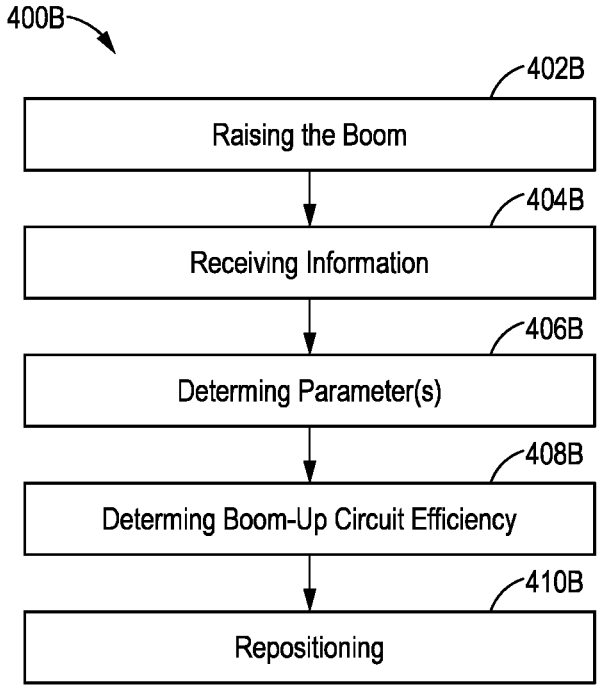
FIG. 4B is an exemplary block diagram illustrating an exemplary embodiment of a portion of the method of FIG. 4.

FIG. 4B illustrates an embodiment of blocks 402-410 of method 400 in which an exemplary boom-up circuit efficiency is determined. In the exemplary flowchart of FIG. 4B, block 402B corresponds to block 402 of FIG. 4, block 404B corresponds to block 404, block 406B corresponds to block 406, block 408B corresponds to block 408, block 410B corresponds to block 410 of FIG. 4.

In block 402B, the method 400B may include raising the boom 118 from a starting position to a test position. The direction may be oriented upward relative to the starting position or relative to the body 110 of the machine 100, and may sometimes be referred to as the "boom-up circuit test". In some embodiments, the stick hydraulic cylinder 130 may be retracted toward the body 110 of the machine 100 during the boom-up health test and the bucket 124 may be curled.

In block 404B, the method 400B may further include receiving, by the controller 154, information indicative of one or more measurements associated with the boom 118 that result from block 402B. In the exemplary embodiment, the information may include a pump displacement command for the first pump 139, which is indicative of the pump flow provided by the first pump 139 that is associated with the raising of the boom 118 from the starting position to the test position (the "boom-up pump flow"). The information may further include a boom acceleration and/or a boom angular velocity that is associated with the raising of the boom 118 from the starting position to the test position. The boom angular velocity may be received from IMU sensor 144*a*.

The boom angular velocity received is indicative of the hydraulic fluid flow input to the boom hydraulic cylinder 120 (the "boom cylinder flow") that is associated with the raising of the boom 118 from the starting position to the test position.

In block 406B, the method 400B may further include determining (by the controller 154) one or more parameters based on the information. The one or more parameters may include the boom-up pump flow of the first pump 139 and the boom cylinder flow for the boom 118 during the raising of the boom 118 to the test position. In an embodiment, the boom-up pump flow of the first pump 139 (hydraulic fluid flow provided by the first pump 139 for the raising of block 402B) may be determined from the pump displacement command for the first pump 139. The boom cylinder flow may be calculated, as is known, based on the boom angular velocity received from the IMU sensor 144*a*.

In block 408B, the method 400B may further include determining the boom-up circuit efficiency by comparing the boom cylinder flow to the check value of the calculated boom-up pump flow (that is based on the pump displacement command for raising the boom 118). In an embodiments, a ratio of parameter (e.g., boom cylinder flow) to check value (e.g., boom-up pump flow) may be calculated. As noted earlier herein, in some embodiments, a difference between the check value and the parameter may be calculated. In some embodiments, the check value may be a threshold to which the parameter is compared.

In block 410B, the method may optionally include repositioning the machine 100 (e.g., repositioning the boom 118) to a test starting position. Blocks 402B-410B may be repeated as desired. In some embodiments, the controller 154 may cycle the machine 100 through the boom-up circuit test of blocks 402B to 408B multiple times (e.g., three times) and determine an average boom-up circuit efficiency based on the plurality of the test cycles for the boom-up circuit test.

Figure 4C:
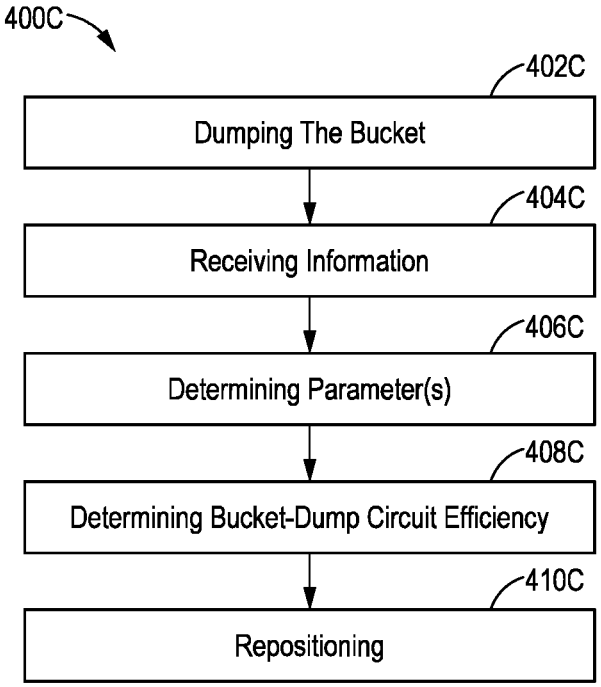
FIG. 4C is an exemplary block diagram illustrating an exemplary embodiment of a portion of the method of FIG. 4.

FIG. 4C illustrates an embodiment of blocks 402-410 of method 400 for determining an exemplary bucket-dump circuit efficiency. In the exemplary flowchart of FIG. 4C, block 402C corresponds to block 402 of FIG. 4, block 404C corresponds to block 404, block 406C corresponds to block 406, block 408C corresponds to block 408, block 410C corresponds to block 410 of FIG. 400.

In block 402C, the method 400C may further include dumping the bucket 124 by moving the bucket 124 from the starting position to a test position. This health test may sometimes be referred to as the "bucket-dump circuit test". In some embodiments, the stick 128 may be generally vertically positioned with respect to the machine 100 during this test.

In block 404C, the method 400 further includes receiving, by the controller 154, information indicative of one or more measurements associated with the dumping of the bucket 124 in block 402C. In the exemplary embodiment, the information may include a pump displacement command for the first pump 139, which is indicative of the pump flow provided by the first pump 139 that is associated with the dumping of the bucket 124 (the "bucket-dump pump flow"). The information may further include a bucket dump angular velocity. In the exemplary embodiment, the bucket dump angular velocity may be received from IMU sensor 144*b*. The bucket dump angular velocity received is indicative of the hydraulic fluid flow input to the bucket hydraulic cylinder 132 (the "bucket-dump cylinder flow") that is associated with the dumping of the bucket 124 in this test.

In block 406C, the method 400C may further include determining (by the controller 154) one or more parameters based on the information. The one or more parameters may include the bucket-dump pump flow and the bucket-dump cylinder flow during the dumping of the bucket 124 (movement to the test position). In an embodiment, the bucket-dump pump flow of the first pump 139 (hydraulic fluid flow provided by the first pump 139 for the "dumping" of block 402C) may be determined from the pump displacement command, as is known in the art. The bucket-dump cylinder flow may be calculated based on the bucket dump angular velocity received from the IMU sensor 144*b*, as is known in the art.

In block 408C, the method 400C may further include determining the bucket-dump circuit efficiency by comparing the bucket-dump cylinder flow to the check value of the calculated bucket-dump pump flow (that is based on the pump displacement command). In an embodiment, a ratio of parameter (bucket-dump cylinder flow) to check value (bucket-dump pump flow) may be calculated. In some embodiments, a difference between the check value and the parameter may be calculated. In some embodiments, the check value may be a threshold to which the parameter is compared.

In block 410C, the method 400C may optionally include repositioning the machine 100 (e.g., repositioning the bucket 124) to a test starting position. Blocks 402C-410C may be repeated as desired. In some embodiments, the controller 154 may cycle the machine 100 through the bucket-dump circuit test of blocks 402C to 408C multiple times (e.g., three times) and determine an average bucket-dump circuit efficiency based on the plurality of the test cycles for the bucket-dump circuit test.

Figure 4D:
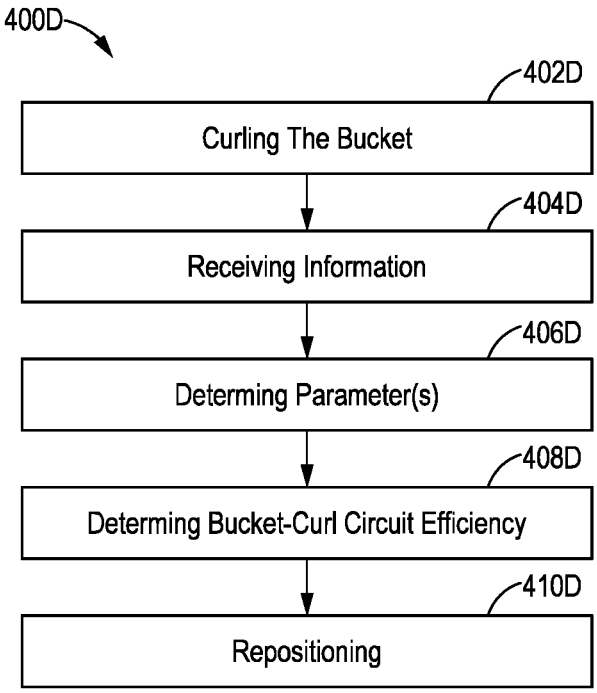
FIG. 4D is an exemplary block diagram illustrating an exemplary embodiment of a portion of the method of FIG. 4.
Figure 4E:
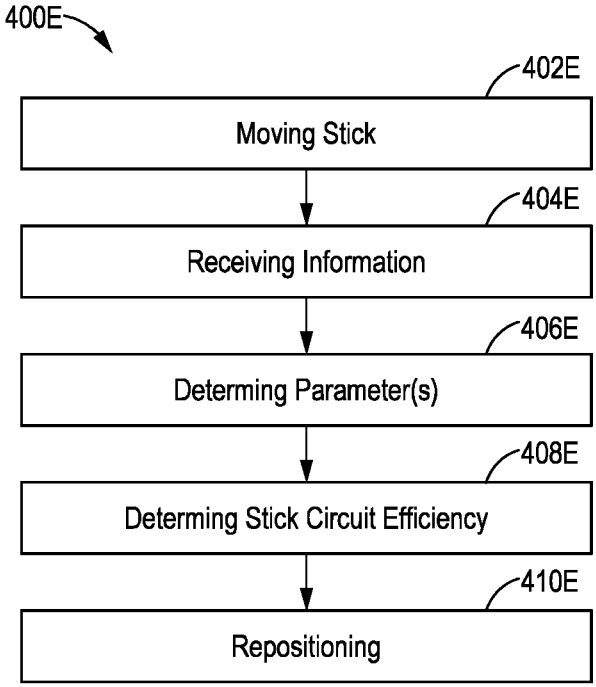
FIG. 4E is an exemplary block diagram illustrating an exemplary embodiment of a portion of the method of FIG. 4.

FIG. 4D illustrates an embodiment of blocks 402-410 of method 400 for determining an exemplary bucket-curl efficiency. In the exemplary flowchart of FIG. 4D, block 402D corresponds to block 402 of FIG. 4, block 404D corresponds to block 404, block 406D corresponds to block 406, block 408D corresponds to block 408, block 410D corresponds to block 410 of FIG. 400.

In block 402D, the method 400D may further include curling the bucket 124 by moving the bucket from a starting position to a test position. This health test may sometimes be referred to as the "bucket-curl circuit test". In some embodiments, the stick 128 may be generally vertically positioned with respect to the machine 100.

In block 404D, the method 400D further includes receiving, by the controller 154, information indicative of one or more measurements associated with the curling of the bucket 124 in block 402D. In the exemplary embodiment, the information may include a pump displacement command for the first pump 139, which is indicative of the pump flow provided by the first pump 139 that is associated with the curling of the bucket 124 (the "bucket-curl pump flow"). The information may further include a bucket curl angular velocity. In the exemplary embodiment, bucket curl angular velocity may be received from the IMU sensor 144*b*. The bucket curl angular velocity received is indicative of the hydraulic fluid flow input to the bucket hydraulic cylinder 132 (the "bucket-curl cylinder flow") that is associated with the curling of the bucket 124 in this test.

In block 406D, the method 400D may further include determining (by the controller 154) one or more parameters based on the information. The one or more parameters may include the bucket-curl pump flow of the first pump 139 and the bucket-curl cylinder flow during the curling of the bucket 124 (movement to the test position). In an embodiment, the bucket-curl pump flow of the second pump 139 (hydraulic fluid flow provided by the first pump 139 for the "curling" of block 402D) may be determined from the pump displacement command. The bucket-curl cylinder flow may be calculated based on the bucket curl angular velocity received from the IMU sensor 144*b*.

In block 408D, the method 400D may further include determining the bucket-curl circuit efficiency by comparing the bucket-curl cylinder flow to the check value of the calculated bucket-curl pump flow (that is based on the pump displacement command). In an embodiment, a ratio of parameter (bucket-curl cylinder flow) to check value (bucket-curl pump flow) may be calculated. As noted earlier herein, in some embodiments, a difference between the check value and the parameter may be calculated. In some embodiments, the check value may be a threshold to which the parameter is compared.

In block 410D, the method 400D may optionally include repositioning the machine 100 (e.g., repositioning the bucket 124) to a test starting position. Blocks 402D-410D may be repeated as desired. In some embodiments, the controller 154 may cycle the machine 100 through the bucket-curl circuit test of blocks 402D to 408D multiple times (e.g., three times) and determine an average bucket-curl circuit efficiency based on the plurality of the test cycles for the bucket-curl circuit test.

In this second exemplary embodiment of the method 400, the pump health may be determined by determining the pump volumetric efficiency and/or a pump status for the first pump 139. In this exemplary embodiment, the pump volumetric efficiency may be determined as an average of the circuit efficiency for each of the boom-up circuit, the bucket-dump circuit and the bucket-curl circuit. The pump status (for the first pump 139) may be "failing" when the determined volumetric efficiency for the first pump 139 is equal to or less than a failure threshold value. The pump status may be "predicted to fail" when the determined volumetric efficiency for the first pump 139 is in a predicted to fail range (typically a range that is above the failure threshold value but well below a normal/passing threshold value or range). The pump status may be "out of specification" when the determined volumetric efficiency for the first pump 139 is above the predicted to fail range but outside (too high or too low) of a normal/passing range. The pump status may be "normal" or "passing" when the volumetric efficiency for the first pump 139 is in a normal/passing range for the first pump 139.

FIGS. 5A-B is an exemplary flowchart illustrating sample blocks which may be followed in method 500 of determining a health status of a hydraulic system 119 via conducting Stall Health Tests that determine an in-line relief valve leakage status and/or a main control valve leakage status for one or more main control valves 137 or in-line relief valves 138 in the hydraulic system 119 or circuit thereof of the machine 100.

In block 502, the method 500 further includes activating stalling of movement of the stick 128 inward toward the body 110 of the machine 100 from a test position. This health test may sometimes be referred to as the "stick-in-stall health test". In some embodiments, the boom 118 and stick hydraulic cylinder 130 may be generally extended and the bucket 124 dumped at the start of the generally static stick-in-stall health test. During this test, as is known in the art, the stick spool in the main control valve 137 will be actuated to the "stick in" position and the second pump 134 will be commanded by the controller 154 to move the stick 128 inward. The stick hydraulic cylinder 130, being at the end of stroke, will not move and pressure will build in the stick circuit 184. This pressure will be relieved by either the stick-in-line relief valve 138*d* (in fluid communication with the stick hydraulic cylinder 130) or the main control valve(s) 137*a* (in fluid communication with the second pump 134 and the stick hydraulic cylinder 130).

In block 504, the method 500 further includes receiving, by the controller 154, information indicative of one or more measurements associated with the stick 128 that result from block 502. In the exemplary embodiment, the information may include a stalled-stick-in pump pressure associated with the stalling of movement the stick 128 inward toward the body 110 of the machine 100. The stalled-stick-in pump pressure may be received from a first pressure sensor 146*a* disposed on the machine 100 and configured to measure pressure at the output of the second pump 134. The pressure at the head end 141 of the stick hydraulic cylinder 130 (the "stick head-end pressure" may also be received by the controller 154 from a head-end stick cylinder pressure sensor 146*d*2.

In block 506, the method 500 may further include determining (by the controller 154) one or more parameters based on the information. The one or more parameters may include "stalled-stick-in pump pressure" at the output of the second pump 134 as measured by the first pressure sensor 146*a*, and/or the stick head-end pressure.

In block 508, the method 500 may further include comparing one or more parameters (e.g., stalled-stick-in pump pressure) to a check range/value. In some embodiments, a difference between the check range or value (e.g., a specification range or value), and the parameter may be calculated. In other embodiments, the comparison may be to a check value may be a threshold to which the parameter is compared.

In block 510, the method 500 may further include determining an in-line relief valve 138 leakage status and/or a main control valve 137 leakage status based on the comparison of the stalled-stick-in pump pressure to the check range or value. The in-line relief valve 138*d* leakage status and/or a main control valve 137*a* leakage status may be categorized as "out of specification" or "normal/passing". For example, in an embodiment, the stalled-stick-in pump pressure may be compared to a pump specification (check range) and the status of the in-line relief valve 138*d* or main control valve 137*a* deemed to be normal/passing if the stalled-stick-in pump pressure is within the check range, or out of specification if outside of the check range (if above an upper threshold of the range (in other words if too high) or if below a lower threshold of the range (too low)). In some embodiments, the controller 154 may cycle the machine 100 through the stick-in-stall health test of blocks 502 to 510 multiple times (e.g., three times) and determine an in-line relief valve 138*d* leakage status and/or a main control valve 137*a* leakage status based on the results of a plurality of test cycles for the stick-in-stall health test.

In block 512, the method 500 further includes activating stalling of dumping the bucket 124 when the bucket 124 is disposed in a test position. This health test may sometimes be referred to as the "bucket-dump-stall health test". In some embodiments, the boom hydraulic cylinder 120 may be extended and the bucket hydraulic cylinder 132 may be generally retracted, and the bucket 124 may be dumped at the start of the bucket-dump-stall health test. During this test, as is known in the art, the bucket spool in the main control valve 137 will be actuated to the "bucket dump" position and the first pump 139 is commanded by the controller 154 to move the bucket 124. The bucket hydraulic cylinder 130, being at the end of stroke, will not move and pressure will build in the bucket-dump circuit 190. This pressure will be relieved by either the bucket-in-line relief valve 138*c* (in fluid communication with the bucket hydraulic cylinder 132) or the main control valve(s) 137*b* (in fluid communication with the first pump 139 and the bucket hydraulic cylinder 132).

In block 514, the method 500 further includes receiving, by the controller 154, information indicative of one or more measurements associated with the bucket 124 that result from block 512. In the exemplary embodiment, the information may include a "stalled-dump pump pressure" associated with the stalling of the dump of the bucket 124. The stalled-dump pump pressure may be received from a second pressure sensor 146*b* disposed on the machine 100 and configured to measure pressure at the output of the first pump 139. The pressure at the head end 141 of the bucket hydraulic cylinder 132 (the "bucket head-end pressure" may also be received by the controller 154 from a head-end bucket cylinder pressure sensor 146*e*1.

In block 516, the method 500 may further include determining (by the controller 154) one or more parameters based on the information. The one or more parameters may include the stalled-dump pump pressure at the output of the first pump 139, as measured by the second pressure sensor 146*b*, and/or the bucket head-end pressure.

In block 518, the method 500 may further include comparing one or more parameters (e.g., stalled-dump pump pressure) to a check range or value. As noted earlier herein, in some embodiments, a difference between the check range or value (e.g., a specification range or value), and the parameter may be calculated. In other embodiments, the comparison may be to a check value that is a threshold to which the parameter is compared.

In block 520, the method 500 may further include determining an in-line relief valve 138*c* leakage status and/or a main control valve 137*b* leakage status based on the comparison of the stalled-dump pump pressure to the check range or value. The in-line relief valve 138*c* leakage status and/or a main control valve 137*b* leakage status may be categorized as out of specification or normal/passing. For example, in an embodiment, the stalled-dump pump pressure may be compared to a pump specification (check range) and the status of the in-line relief valve 138*c* or main control valve 137*b* deemed to be normal/passing if the stalled-dump pump pressure is within the check range, or out of specification if outside of the check range. In some embodiments, the controller 154 may cycle the machine 100 through the bucket-dump-stall health test of blocks 512 to 520 multiple times (e.g., three times) and determine an in-line relief valve 138*c* leakage status and/or a main control valve 137*b* leakage status based on the results of a plurality of test cycles for the bucket-dump-stall health test.

In block 522, the method 500 further includes activating stalling of swinging/pivoting the upper frame 104 in the first direction from a starting position to a test position. The first direction may be oriented toward the left-side relative to the forward direction of travel of the machine 100. This health test may sometimes be referred to as the "swing-left-stall health test". In some embodiments, the boom 118 and stick 128 may be generally extended and the bucket 124 curled at the start of the generally static swing-left-stall health test. During this test, the upper frame 104 is swung/pivoted from a starting position to a test position while the swing brake 117 is engaged. To actuate the swinging/pivoting, the upper frame spool in the main control valve 137 (which is in fluid communication with the swing motor 126) will be actuated to the "swing-left" position and the second pump 134 will be commanded by the controller 154 to swing/pivot the upper frame 104 to the left (counterclockwise). Because the swing brake 117 is engaged, pressure will build in the left-swing circuit 180 as movement of the upper frame 104 is resisted by the swing brake 117. This pressure will be relieved by either the in-line relief valve 138*a* (in fluid communication with the swing motor 126) or the main control valve(s) 137*a* (in fluid communication with the swing motor 126).

In block 524, the method 500 further includes receiving, by the controller 154, information indicative of one or more measurements associated with the stalling of the swinging/pivoting of the upper frame 104 that result from block 522. In the exemplary embodiment, the information may include a "stalled-left-swing pump pressure" associated with the stalling of swinging of the upper frame 104 in the first direction toward the left-side and measured at the output of the second pump 134. The stalled-left-swing pump pressure may be received from the first pressure sensor 146*a*. The information received may also include data indicative of the swing angle (received from the swing angle sensor 142) that is associated with the swinging of the upper frame 104 during this test.

In block 526, the method 500 may further include determining (by the controller 154) one or more parameters based on the information. The one or more parameters may include the stalled-left-swing pump pressure measured at the second pump 134 and the swing angle.

In block 528, the method 500 may further include comparing one or more parameters (e.g., stalled-left-swing pump pressure) to a check range or value. As noted earlier herein, in some embodiments, a difference between the check range or value (e.g., a specification range or value), and the parameter may be calculated. In other embodiments, the comparison may be to a check value that may be a threshold to which the parameter is compared.

In block 530, the method 500 may further include determining a swing brake status and/or an in-line relief valve 138*a* leakage status and/or a main control valve 137*a* leakage status. For example, if the swing angle changes during this test, the swing brake 117 is deemed to be failing or failed. The in-line relief valve 138*a* leakage status and/or a main control valve 137*a* leakage status may be determined based on the comparison of the stalled left-swing pump pressure to the check range/value. The in-line relief valve 138*a* leakage status and/or a main control valve 137*a* leakage status may be categorized as out of specification or normal/passing. For example, in an embodiment, the stalled-left-swing pump pressure may be compared to a pump specification (check range) and deemed to be normal/passing if in the range or out of specification if outside of the range. In some embodiments, the controller 154 may cycle the machine 100 through the swing-left-stall health test of blocks 522 to 530 multiple times (e.g., three times) and determine an in-line relief valve 138*a* leakage status and/or a main control valve 137*a* leakage status based on the results of a plurality of test cycles for the swing-left-stall health test.

In block 532, the method 500 further includes activating stalling of swinging the upper frame 104 in the second direction when from a starting position to a test position. The second direction may be oriented toward the right-side relative to the forward direction of travel of the machine 100. This health test may sometimes be referred to as the "swing-right-stall health test". In some embodiments, the boom 118 and stick 128 may be generally extended and the bucket 124 curled at the start of the generally static swing-right-stall health test. During this test, the upper frame 104 is swung right (clockwise) from a starting position to a test position while the swing brake 117 is engaged. To actuate the swinging, the spool in the main control valve 137 associated with the swing motor 126 will be actuated to the "swing-right" position and the second pump 134 will be commanded by the controller 154 to swing the upper frame 104 to the right. Because the swing brake 117 is engaged, pressure will build in the right-swing circuit 182 as movement of the upper frame 104 is resisted by the swing brake 117. This pressure will be relieved by either the in-line relief valve 138*a* (in fluid communication with the swing motor 126) or the main control valve(s) 137*a* (in fluid communication with the swing motor 126).

In block 534, the method 500 further includes receiving, by the controller 154, information indicative of one or more measurements associated with the stalling of the swing of the upper frame 104 that result from block 532. In the exemplary embodiment, the information may include a "stalled-right-swing pump pressure" associated with the stalling of swinging of the upper frame 104 in the second direction toward the right-side and measured at the output of the second pump 134. The stalled-right-swing pump pressure may be received from the first pressure sensor 146*a*. The information received may also include data indicative of the swing angle (received from the swing angle sensor 142) that is associated with the swinging of the upper frame 104 during this test.

In block 536, the method 500 may further include determining (by the controller) one or more parameters based on the information. The one or more parameters may include the stalled-right-swing pump pressure measured at the second pump 134 and the swing angle.

In block 538, the method 500 may further include comparing one or more parameters (e.g., stalled-right-swing pump pressure) to a check range or value. As noted earlier herein, in some embodiments, a difference between the check range or value (e.g., a specification range or value), and the parameter may be calculated. In other embodiments, the comparison may be to a check value that may be a threshold to which the parameter is compared.

In block 540, the method 500 may further include determining a swing brake status and/or a relief valve 138*a* leakage status and/or a main control valve 137*a* leakage status. For example, if the swing angle changes during this test, the swing brake 117 is deemed to be failing or failed. The in-line relief valve 138*a* leakage status and/or a main control valve 137*a* leakage status may be determined based on the comparison of the stalled-right-swing pump pressure to the check range/value. The in-line relief valve 138*a* leakage status and/or a main control valve 137*a* leakage status may be categorized as out of specification or normal/passing. For example, in an embodiment, the stalled-right-swing pump pressure may be compared to a pump specification (check range/value) and deemed to be normal/passing or out of specification if in the range or out of specification if outside of the range for the second pump 134. In some embodiments, the controller 154 may cycle the machine 100 through the swing-right-stall health test of blocks 532 to 540 multiple times (e.g., three times) and determine an in-line relief valve 138*a* leakage status and/or a main control valve 137*a* leakage status based on the results of a plurality of test cycles for the swing-right-stall health test.

In block 542, the method 500 may further include activating stalling of raising of the boom 118 from a starting position to a test position. This health test may sometimes be referred to as the "boom-up-stall health test". In some embodiments, the boom 118 and stick 128 may be generally extended and the bucket 124 curled at the start of the generally static boom-up-stall health test During this test, as is known in the art, the boom spool in the main control valve 137*b* (which is in fluid communication with the boom hydraulic cylinder 120) will be actuated to the "boom up" position and the first pump 139 will be commanded by the controller 154 to move the boom upward. The boom hydraulic cylinder 120 being at the end of stroke will not move and pressure will build in the boom-up circuit 186. This pressure will be relieved by either the boom in-line relief valve 138 or the main control valve(s) 137*b*.

In block 544, the method 500 further includes receiving, by the controller 154, information indicative of one or more measurements associated with the boom 118 that result from block 542. In the exemplary embodiment, the information may include a stalled boom-up pump pressure associated with the stalling of raising of the boom 118. The stalled-boom-up pump pressure may be received from the second pressure sensor 146*b* disposed on the machine 100 and configured to measure pressure at the output of the first pump 139. The pressure at the head end 141 of the boom hydraulic cylinder 120 (the "boom head-end pressure") may also be received by the controller 154 from a head-end boom cylinder pressure sensor 146*c*2.

In block 546, the method 500 may further include determining (by the controller 154) one or more parameters based on the information. The one or more parameters may include the stalled-boom-up pump pressure measured at the output of the first pump 139, and/or the boom head-end pressure.

In block 548, the method 500 may further include comparing one or more parameter (e.g., stalled-boom-up pump pressure) to a check range or value. As noted earlier herein, in some embodiments, a difference between the check range or value (e.g., a specification range or value) and the parameter may be calculated. In other embodiments, the comparison may be to a check value that is a threshold to which the parameter is compared.

In block 550, the method may further include determining an in-line relief valve 138*b* leakage status and/or a main control valve 137*b* leakage status based on the comparison of the stalled boom-up pump pressure to the check range/value. The in-line relief valve 138*b* leakage status and/or a main control valve 137*b* leakage status may be categorized as out of specification or normal/passing. For example, in an embodiment, the stalled boom-up pump pressure is may be compared to a pump specification (check range) and deemed to be normal/passing if in range or out of specification if outside the range. In some embodiments, the controller 154 may cycle the machine 100 through the boom-up-stall health test of blocks 542 to 550 multiple times (e.g., three times) and determine an in-line relief valve 138*b* leakage status and/or a main control valve 137*b* leakage status based on the results of a plurality of test cycles for the boom-up-stall health test.

In block 552, the method 500 further includes activating stalling of moving the stick 128 outward from the body 110 of the machine 100. This health test may sometimes be referred to as the "stick-out-stall health test". In some embodiments, the boom 118 may be generally extended and stick 128 may be generally retracted and the bucket 124 curled at the start of the generally static stick-out-stall health test. During this test, as is known in the art, the stick spool in the main control valve 137 will be actuated to the "stick out" position and the second pump 134 may be commanded by the controller 154 to move the stick 128 outward. The stick hydraulic cylinder 130 being at the end of stroke will not move and pressure will build in the stick circuit 184. This pressure will be relieved by either the stick in-line relief valve 138*d* or the main control valve(s) 137*a*.

In block 554, the method 500 further includes receiving, by the controller 154, information indicative of one or more measurements associated with the stick 128 that result from block 552. In the exemplary embodiment, the information may include a stalled-stick-out pump pressure associated with the stalling of movement the stick 128 outward from the body 110 of the machine 100. The stalled-stick-out pump pressure may be received from a first pressure sensor 146*a* disposed on the machine 100 and configured to measure pressure at the output of the second pump 134. The pressure at the head end 141 of the stick hydraulic cylinder 130 (the "stick head-end pressure" may also be received by the controller 154 from a head-end stick cylinder pressure sensor 146*d*2.

In block 556, the method 500 may further include determining (by the controller 154) one or more parameters based on the information. The one or more parameters may include stalled-stick-out pump pressure at the output of the second pump 134, and/or the stick head-end pressure.

In block 558, the method 500 may further include comparing one or more parameters (e.g., stalled-stick-out pump pressure) to a check range or value. As noted earlier herein, in some embodiments, a difference between the check range or value (e.g., a specification range or value) and the parameter may be calculated. In other embodiments, the comparison may be to a check value that is a threshold to which the parameter is compared.

In block 560, the method 500 may further include determining an in-line relief valve leakage status and/or a main control valve leakage status based on the comparison of the stalled-stick-out pump pressure to the check range or value. The in-line relief valve 138*d* leakage status and/or a main control valve 137*a* leakage status may be categorized as out of specification or normal/passing. For example, in an embodiment, the stalled-stick out pump pressure is may be compared to a pump specification (check range) and deemed to be normal/passing if in range or out of specification if outside the range. In some embodiments, the controller 154 may cycle the machine 100 through the stick-in-stall health test of blocks 552 to 560 multiple times (e.g., three times) and determine an in-line relief valve 138*d* leakage status and/or a main control valve 137*a* leakage status based on the results of a plurality of test cycles.

In block 562, the method 500 further includes activating curling of the bucket 124. This health test may sometimes be referred to as the "bucket-curl-stall health test". In some embodiments, the boom 118 may be generally extended and stick 128 may be generally retracted and the bucket 124 in a curled position at the start of the generally static bucket-curl-stall health test. During this test, as is known in the art, the bucket spool in the main control valve 137 will be actuated to the "bucket curl" position and the first pump 139 will be commanded by the controller 154 to move the bucket 124. The bucket hydraulic cylinder 132 being at the end of stroke will not move and pressure will build in the bucket curl circuit 188. This pressure will be relieved by either the bucket-in-line relief valve 138*c* or the main control valve(s) 137*b*.

In block 564, the method 500 further includes receiving, by the controller 154, information indicative of one or more measurements associated with the bucket 124 that result from block 562. In the exemplary embodiment, the information may include a stalled-curl pump pressure associated with the stalling of the curling of the bucket 124. The stalled-curl pump pressure may be received from a second pressure sensor 146*b* disposed on the machine 100 and configured to measure pressure at the output of the first pump 139. The pressure at the head end 141 of the bucket hydraulic cylinder 132 (the "bucket head-end pressure" may also be received by the controller 154 from a head-end bucket cylinder pressure sensor 146*e*1.

In block 566, the method 500 may further include determining (by the controller) one or more parameters based on the information. The one or more parameters may include the stalled-curl pump pressure at the output of the first pump 139, and/or the bucket head-end pressure.

In block 568, the method may further include comparing one or more parameters (e.g., stalled-curl pump pressure) to a check range or value. As noted earlier herein, in some embodiments, a difference between the check range or value and the parameter may be calculated. In some embodiments, the check value may be a threshold to which the parameter is compared.

In block 570, the method 500 may further include determining an in-line relief valve 138*c* leakage status and/or a main control valve 137*b* leakage status based on the comparison of the stalled-curl pump pressure to the check range or value. The in-line relief valve leakage status and/or a main control valve leakage status may be categorized as out of specification or normal/passing. For example, in an embodiment, the stalled-curl pump pressure may be compared to a pump specification (check range) and deemed to be normal/passing if in range or out of specification if outside the check range. In some embodiments, the controller 154 may cycle the machine 100 through the bucket-curl-stall health test of blocks 562 to 570 multiple times (e.g., three times) and determine an in-line relief valve 138*c* leakage status and/or a main control valve 137*b* leakage status based on the results of a plurality of test cycles for the bucket-curl-stall health test.

FIG. 6 is an exemplary flowchart illustrating sample blocks which may be followed in method 600 of determining a health status of a hydraulic system 119 via conducting Drift Health Tests that determine cylinder drift status for the boom hydraulic cylinders 120, stick hydraulic cylinder 130 and/or bucket hydraulic cylinder 132 in the hydraulic system 119 or circuit thereof of the machine 100.

In block 602, the method 600 includes moving the boom 118 from the starting position to a test position. This health test may sometimes be referred to as the "boom-drift health test".

In block 604, the method 600 further includes receiving, by the controller 154, information indicative of one or more measurements associated with the boom 118 in block 602. In the exemplary embodiment, the information may include data indicative of a boom hydraulic cylinder length received from IMU 144*a*.

In block 606, the method 600 may further include determining (by the controller 154) one or more parameters based on the information. The one or more parameters may include a boom hydraulic cylinder length associated with the boom 118 in the test position. The boom hydraulic cylinder length may be calculated by the controller 154 based on the data received from the IMU 144*a*.

In block 608, the method 600 may further include comparing each parameter to a check range or value. As noted earlier herein, in some embodiments, a difference between the check range or value and the parameter may be calculated. In some embodiments, the check value may be a threshold to which the parameter is compared.

In block 610, the method 600 may further include determining the cylinder drift status for the boom hydraulic cylinder 120 based boom hydraulic cylinder length. The cylinder drift status may be categorized as out of specification or normal/passing. In some embodiments, the controller 154 may cycle the machine 100 through the boom-drift health test of blocks 602 to 610 multiple times (e.g., three times) and determine the cylinder drift status for the boom hydraulic cylinder 120 based on the results of a plurality of test cycles for the boom-drift health test In block 612, the method 600 further includes moving the stick 128 from the starting position to a test position. This health test may sometimes be referred to as the "stick-drift health test".

In block 614, the method 600 further includes receiving, by the controller 154, information indicative of one or more measurements associated with the stick 128 in block 612. In the exemplary embodiment, the information may include data indicative of a stick hydraulic cylinder length in the test-position. Such data may be received from a IMU sensor 144*c* that is in communication with the controller 154.

In block 616, the method 600 may further include determining (by the controller 154) one or more parameters based on the information. The one or more parameters may include a stick hydraulic cylinder length associated with the stick 128 in the test position. The stick hydraulic cylinder length may be calculated by the controller 154 based on the data received from the IMU 144*c*.

In block 618, the method 600 may further include comparing each parameter to a check range or value. As noted earlier herein, in some embodiments, a difference between the check range or value and the parameter may be calculated. In some embodiments, the check value may be a threshold to which the parameter is compared.

In block 620, the method 600 may further include determining the cylinder drift status for the stick hydraulic cylinder 130 based on the stick hydraulic cylinder length. The stick-drift status may be categorized as out of specification or normal/passing. In some embodiments, the controller 154 may cycle the machine 100 through the stick-drift health test of blocks 612 to 620 multiple times (e.g., three times) and determine the cylinder drift status for the stick hydraulic cylinder 130 based on the results of a plurality of test cycles for the stick-drift health test.

In block 622, the method 600 further includes moving the bucket 124 from the starting position to a test-position. This health test may sometimes be referred to as the "bucket-dump-drift health test".

In block 624, the method 600 further includes receiving, by the controller 154, information indicative of one or more measurements associated with the bucket 124 in block 622. In the exemplary embodiment, the information may include data indicative of a first bucket hydraulic cylinder length in the test-position. Such data may be received from a IMU sensor 144*b* that is in communication with the controller 154.

In block 626, the method 600 may further include determining (by the controller 154) one or more parameters based on the information. The one or more parameters may include a bucket dump cylinder length associated with the bucket 124 in the test position. The bucket dump cylinder length may be calculated by the controller 154 based on the data received from the IMU sensor 144*b*.

In block 628, the method 600 may further include comparing each parameter to an check range or value. As noted earlier herein, in some embodiments, a difference between the check range or value and the parameter may be calculated. In some embodiments, the check value may be a threshold to which the parameter is compared.

In block 630, the method 600 may further include determining the bucket dump drift status for the bucket hydraulic cylinder 132 based on the bucket dump cylinder length. The bucket dump drift status may be categorized as out of specification or normal/passing. In some embodiments, the controller 154 may cycle the machine 100 through the bucket-dump-drift health test of blocks 622 to 630 multiple times (e.g., three times) and determine the bucket dump drift status for the bucket hydraulic cylinder 132 based on the results of a plurality of test cycles for the bucket-dump-drift health test.

In block 632, the method 600 further includes moving the bucket 124 from the starting position to a test position. This health test may sometimes be referred to as the "bucket-curl-drift health test".

In block 634, the method 600 further includes receiving, by the controller 154, information indicative of one or more measurements associated with the bucket 124 in block 446. In the exemplary embodiment, the information may include data indicative of the bucket hydraulic cylinder length in the bucket-curl-drift-test-position. Such data may be received from the IMU sensor 144*b*.

In block 636, the method 600 may further include determining (by the controller 154) one or more parameters based on the information. The one or more parameters may include a bucket curl cylinder length (e.g., length of the bucket hydraulic cylinder 132) associated with the bucket 124 in the bucket-curl-drift-test-position. The bucket curl cylinder length may be calculated by the controller 154 based on the data received from the IMU sensor 144*b*.

In block 638, the method 600 may further include comparing each parameter to an check range or value. As noted earlier herein, in some embodiments, a difference between the check range or value and the parameter may be calculated. In some embodiments, the check value may be a threshold to which the parameter is compared.

In block 640, the method 600 may further include determining the bucket curl drift status for the bucket hydraulic cylinder 132 based on the bucket curl cylinder length. The bucket curl drift status may be categorized as out of specification or normal/passing. In some embodiments, the controller 154 may cycle the machine 100 through the bucket-curl-drift health test of blocks 632 to 640 multiple times (e.g., three times) and determine the bucket curl drift status for the bucket hydraulic cylinder 132 based on the results of a plurality of test cycles for the bucket-curl-drift health test.

FIG. 7 is an exemplary flowchart illustrating sample blocks which may be followed in method 700 of determining a health status of a hydraulic system 119 via conducting Seal Leak Health Tests that determine cylinder leak status for the boom hydraulic cylinders 120, stick hydraulic cylinder 130, and bucket hydraulic cylinder 132 in the hydraulic system 119 or circuit thereof of the machine 100.

In block 702, the method 700 further includes moving the boom 118 from the starting position to a test position. In some embodiments, the boom 118 may be generally extended and stick 128 may be generally retracted and the bucket 124 extended to a dumping position. This health test may sometimes be referred to as the "boom-cylinder-leak health test".

In block 704, the method further includes receiving, by the controller 154, information indicative of one or more measurements associated with the boom 118 in block 702. In the exemplary embodiment, the information may include data indicative of a boom hydraulic cylinder pressure indicative of the hydraulic fluid pressure at the rod-end 140 of the boom hydraulic cylinders 120 when the boom 18 is in the test position. The boom-leak cylinder pressure may be received by the controller 154 from the rod-end boom-cylinder pressure sensor 146*c*1. The information may also include data indicative of a boom cylinder pressure indicative of the hydraulic fluid pressure at the head-end 141 of the boom hydraulic cylinders 120 when the boom 118 is in the test position. The boom cylinder pressure may be received by the controller 154 from the rod end boom-cylinder pressure sensor 146*c*1 and the head end boom-cylinder pressure sensor 146*c*2.

In block 706, the method 700 may further include determining (by the controller) one or more parameters based on the information. The one or more parameters may include the boom hydraulic cylinder 120 pressures measured at the rod-end 140 and at the head-end 141 of the boom hydraulic cylinders 120.

In block 708, the method 700 may further include comparing the parameter (e.g., boom hydraulic cylinder pressure at the rod-end 140 and at the head-end 141) to respective check ranges or values. As noted earlier herein, in some embodiments, a difference between the check range or value and the parameter may be calculated. In some embodiments, the check value may be a threshold to which the parameter is compared.

In block 710, the method 700 may further include determining a cylinder leak status for the boom hydraulic cylinder 120 based on the comparison of the head end and rod end boom hydraulic cylinder pressures to the respective check ranges or values. The cylinder leak status for the boom hydraulic cylinder 120 may be categorized as failing (when either the head end or rod end pressure is equal to or less than a failure threshold value), predicted to fail (when either the head-end or rod-end pressure is in a predicted to fail range (typically a range that is above the failure threshold value but well below a normal/passing threshold value or range), out of specification (when either of the determined head end or rod end pressures is above the predicted to fail range but outside (too high or too low) of a normal/passing range) or normal/passing (when the head end and rod end pressures are both in a normal/passing range). In some embodiments, the controller 154 may cycle the machine 100 through the boom-cylinder-leak health test of blocks 702 to 710 multiple times (e.g., three times) and determine a cylinder leak status based on the results of a plurality of test cycles for the boom-cylinder-leak health test.

In block 712, the method 700 further includes moving the boom 118 from the starting position to a test position. In some embodiments, the boom 118 may be generally extended and stick 128 may be generally retracted and the bucket 124 extended to a dumping position. This health test may sometimes be referred to as the "stick-cylinder-leak health test".

In block 714, the method further includes receiving, by the controller 154, information indicative of one or more measurements associated with the stick 128 in block 712. In the exemplary embodiment, the information may include data indicative of a stick cylinder pressure indicative of the hydraulic fluid pressure at the head-end 141 and the rod-end 140 of the stick hydraulic cylinder 130 when the stick 128 is in the test position. The stick cylinder pressure may be received by the controller 154 from the head end stick-cylinder pressure sensor 146*d*1 and the rod end stick-cylinder pressure sensor 146*d*2.

In block 716, the method 700 may further include determining (by the controller) one or more parameters based on the information. The one or more parameters may include the stick cylinder pressure measured at the head-end 141 of the stick hydraulic cylinder 130 and the stick cylinder pressure measured at the rod-end 140 of the stick hydraulic cylinder 130.

In block 718, the method 700 may further include comparing the parameter (e.g., stick cylinder pressure measured at the head end 141 and measured at the rod-end 140) to respective check ranges or values. As noted earlier herein, in some embodiments, a difference between the check range or value and the parameter may be calculated. In some embodiments, the check value may be a threshold to which the parameter is compared.

In block 720, the method 700 may further include determining a cylinder leak status for the stick hydraulic cylinder 130 based on the comparison of the stick cylinder head-end and rod-end pressures to respective check ranges or values. The cylinder leak status for the stick hydraulic cylinder 130 may be categorized as failing (e.g., when either the head end or rod end pressure is equal to or less than a failure threshold value), predicted to fail (e.g., when either the head-end or rod-end pressure is in a predicted to fail range (typically a range that is above the failure threshold value but well below a normal/passing threshold value or range) out of specification (e.g., when either of the determined head end or rod end pressures is above the predicted to fail range but outside (too high or too low) of a normal/passing range) or normal/passing (e.g., when the head end and rod end pressures are both in a normal/passing range). In some embodiments, the controller 154 may cycle the machine 100 through the stick-cylinder-leak health test of blocks 712 to 720 multiple times (e.g., three times) and determine a cylinder leak status based on the results of a plurality of test cycles for the stick-cylinder-leak health test.

In block 722, the method 700 further includes moving the boom 118 from the starting position to a test position. In some embodiments, the boom 118 may be generally extended and stick 128 may be generally retracted and the bucket 124 extended to a dumping position. This health test may sometimes be referred to as the "bucket-cylinder-leak health test".

In block 724, the method 700 further includes receiving, by the controller 154, information indicative of one or more measurements associated with the bucket 124 in block 486. In the exemplary embodiment, the information may include data indicative of a bucket cylinder pressure indicative of the hydraulic fluid pressure at the rod-end 140 and at the head-end 141 of the bucket hydraulic cylinder 132 when the bucket 124 is in the test position. The bucket cylinder pressures (head-end and rod-end) may be received by the controller 154 from the head end bucket-cylinder pressure sensor 146*e*1 and the rod end bucket cylinder pressure sensor 146*e*2.

In block 726, the method 700 may further include determining (by the controller) one or more parameters based on the information. The one or more parameters may include the bucket cylinder pressure measured at the rod-end 140 and head-end 141 of the bucket hydraulic cylinder 132.

In block 728, the method 700 may further include comparing each parameter (e.g., rod-end and head-end bucket cylinder pressure) to a check range or range or value. As noted earlier herein, in some embodiments, a difference between the check range or value and the parameter may be calculated. In some embodiments, the check value may be a threshold to which the parameter is compared.

In block 730, the method 700 may further include determining a cylinder leak status for the bucket hydraulic cylinder 132 based on the comparison of the bucket-leak cylinder pressure to the check range or value. The cylinder leak status for the bucket hydraulic cylinder 132 may be categorized as failing (e.g., when either the head end or rod end pressure is equal to or less than a failure threshold value), predicted to fail (e.g., when either the head-end or rod-end pressure is in a predicted to fail range (typically a range that is above the failure threshold value but well below a normal/passing threshold value or range), out of specification (e.g., when either of the determined head end or rod end pressures is above the predicted to fail range but outside (too high or too low) of a normal/passing range) or normal/passing (e.g., when the head end and rod end pressures are both in a normal/passing range). In some embodiments, the controller 154 may cycle the machine 100 through the bucket-cylinder-leak health test of blocks 722 to 730 multiple times (e.g., three times) and determine a cylinder leak status based on the results of a plurality of test cycles for the bucket-cylinder-leak health test.

It may be desirable to perform one or more of the blocks shown in FIGS. 3-7 in an order different from that depicted.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A method for determining a health status of a hydraulic system disposed on a machine, the machine including a body and an attachment disposed on the body, the body including a pivotable upper frame, the attachment including one or more members, the method comprising:

receiving a request to determine a health status of a hydraulic system disposed on a machine, the hydraulic system including a plurality of components, the plurality of components including one or more hydraulic cylinders, one or more pumps, one or more valves, each pump in fluid communication with at least one hydraulic cylinder of the one or more hydraulic cylinders and/or at least one valve, at least one hydraulic cylinder of the one or more hydraulic cylinders coupled to and configured to actuate movement of at least one member of the one or more members disposed on the machine, the member comprising a boom, a stick or a bucket;

in response to the request, automatically conducting a health test and determine the health status, the health test including:

moving at least one member of the one or more members or the upper frame from a starting position to one or more test positions;

receiving information indicative of one or more measurements associated with the moving;

determining from the information one or more parameters, the one or more parameters including one or more pump flows, one or more swing flows, one or more cylinder flows, one or more pump pressures, one or more hydraulic cylinder lengths, one or more hydraulic cylinder head end pressures, or one or more hydraulic cylinder rod end pressures;

comparing each parameter to a check range or value;

determining for one or more components of the hydraulic system a pump volumetric efficiency, a pump status, a main control valve leakage status, an in-line relief valve leakage status, a cylinder drift status or a cylinder seal leak status; and if the pump status, the main control valve leakage status, the in-line relief valve leakage status, the cylinder drift status or the cylinder seal leak status associated with the component is currently failing, predicted to fail or out of specification, identifying the component as service-needed on an output member or activating an alarm of an output member, wherein the attachment includes a first member, a second member and a third member, the first member the boom, the second member the bucket, the bucket coupled to the stick, the third member the stick, wherein the moving, of the at least one member of the one or more members or the upper frame, from the starting position to the one or more test positions includes one or more of:

(a) swinging the upper frame;

(b) raising the boom;

(c) moving the stick inward or outward;

(d) dumping the bucket; or (e) curling the bucket;

wherein the one or more parameters includes:

(a) if the swinging, a pump flow and a swing motor flow during the swinging;

(b) if the raising, a boom-up pump flow and a boom cylinder flow during the raising of the boom;

(c) if the moving of the stick, a stick pump flow and a stick cylinder flow during the moving;

(d) if the dumping, a bucket-dump pump flow and a bucket-dump cylinder flow during the dumping; and (e) if the curling, a bucket-curl pump flow and a bucket-curl cylinder flow during the curling.

2. The method of claim 1, wherein the stick is coupled to the boom, in which the health test further includes:

activating stalling of movement of the stick, dumping of the bucket, swinging of upper frame, raising of the boom or curling of the bucket; and determining an in-line relief valve leakage status and/or a main control valve leakage status based at least in part on the comparing of the one or more parameters to the check range or value, wherein the parameters further include a pump pressure associated with movement of the stick, dumping of the bucket, swinging of the upper frame, raising of the boom or curling of the bucket.

3. The method of claim 1, wherein the stick is coupled to the boom, in which the moving of the one or more members from the starting position to the one or more test positions further includes:

raising the boom to a first test position, moving the stick to a second test position or moving the bucket to a third test position; and determining the cylinder drift status for a boom hydraulic cylinder, stick hydraulic cylinder or bucket hydraulic cylinder based at least in part on cylinder length of the boom hydraulic cylinder, stick hydraulic cylinder or bucket hydraulic cylinder for which the cylinder drift status is determined.

4. The method of claim 1, wherein the stick is coupled to the boom, in which the moving of the at least one member of the one or more members from the starting position to the one or more test positions further includes:

raising the boom to a first test position, moving the stick to a second test position, or moving the bucket to a third test position for dumping;

wherein the information received includes:

(a) a boom cylinder pressure indicative of a hydraulic fluid pressure at a rod-end of a boom hydraulic cylinder when the boom is in the first test position and the boom cylinder pressure indicative of the hydraulic fluid pressure at a head-end of the boom hydraulic cylinder when the boom is in the first test position;

(b) a stick cylinder pressure indicative of a hydraulic fluid pressure at a head-end of a stick hydraulic cylinder when the stick is in the second test position and a stick cylinder pressure indicative of the hydraulic fluid pressure at a rod-end of the stick hydraulic cylinder when the stick is in the second test position; or (c) a dump cylinder pressure indicative of a hydraulic fluid pressure at the rod-end of a bucket hydraulic cylinder when the bucket is in the third test position and a dump cylinder pressure indicative of the hydraulic fluid pressure at a head-end of the bucket hydraulic cylinder when the bucket is in the third test position;

wherein the one or more parameters further include boom cylinder pressure at the head end, boom cylinder pressure at the rod end, stick cylinder pressure at the head end, stick cylinder pressure at the rod end, dump cylinder pressure at the head end, or dump cylinder pressure at the rod end;

determining:

(a) the cylinder leak status for the boom hydraulic cylinder based on the boom cylinder pressure at the head end and/or boom cylinder pressure at the rod end;

(b) the cylinder leak status for the stick hydraulic cylinder based on the stick cylinder pressure at the head end and/or stick cylinder pressure at the rod end; or (c) the cylinder leak status for the bucket hydraulic cylinder based on the bucket cylinder pressure at the head end and/or bucket cylinder pressure at the rod end.

5. The method of claim 1 further comprising activating emission or display of an audible alarm, an alert or a visual warning by an output member associated with the machine when a component is identified as a service-needed.

6. A system for determining a health status, when a hydraulic fluid in the hydraulic system is above a temperature threshold, of a hydraulic system disposed on an excavator, the excavator including a body and an attachment disposed on the body, the body including a pivotable upper frame, the attachment including a boom, a stick and a bucket, the system comprising:

a controller configured to:

receive a request to determine a health status of the hydraulic system, the hydraulic system including a plurality of components, the plurality of components including a boom hydraulic cylinder, a stick hydraulic cylinder, a bucket hydraulic cylinder, a first pump, a second pump, one or more main control valves and/or in-line relief valves, wherein the first pump is in fluid communication with the boom hydraulic cylinder or bucket hydraulic cylinder, wherein the second pump is in fluid communication with a swing motor and the stick hydraulic cylinder, and each of the first and second pumps in fluid communication with at least one of the main control valve and/or in-line relief valve, the boom hydraulic cylinder coupled to and configured to actuate movement of the boom, the stick hydraulic cylinder coupled to and configured to actuate movement of the stick, the bucket hydraulic cylinder coupled to and configured to actuate movement of the bucket, the swing motor configured to actuate swinging of the upper frame;

in response to the request, automatically conduct a health test and determine the health status, the health test including:

move the boom, stick, bucket or upper frame from a starting position to one or more test positions;

receive information indicative of one or more measurements associated with movement of the boom, stick, bucket or upper frame, determine from the information one or more parameters, the one or more parameters including one or more pump flows, one or more swing flows, one or more cylinder flows, one or more pump pressures, one or more hydraulic cylinder lengths, one or more cylinder head end pressures, or one or more cylinder rod end pressures;

compare each parameter to a check range or value;

determine for one or more components of the hydraulic system a volumetric efficiency, a pump status, a main control valve leakage status, an in-line relief valve leakage status, a cylinder drift status or a cylinder seal leak status; and if the pump status, the main control valve leakage status, the in-line relief valve leakage status, the cylinder drift status or the cylinder seal leak status associated with the component is currently failing, predicted to fail or out of specification, identify the component as a service-needed on a display or log and activate an alarm in which the move of the boom, stick, bucket, or upper frame from the starting position to the one or more test positions includes:

(a) swing the upper frame in a first direction from the starting position to a first test position, the first direction oriented toward a left-side relative to a forward direction of travel of the excavator;

(b) swing the upper frame in a second direction from the starting position to a second test position, the second direction oriented toward a right-side relative to the forward direction of travel of excavator;

(c) raise the boom in a third direction from the starting position to a third test position, the third direction oriented upward from the starting position;

(d) move the stick inward or move the stick outward;

(e) dump the bucket by moving the bucket from the starting position to a fourth test position; or (f) curl the bucket by moving the bucket from the starting position to a fifth test position, wherein the information received includes:

(a) if the swing of the upper frame in the first direction to the first test position, a first pump displacement command received from the second pump and data indicative of a first swing angle, each associated with the swing of the upper frame in the first direction to the first test position;

(b) if the swing of the upper frame in the second direction to the second test position, a second pump displacement command for the second pump and data indicative of a second swing angle, each associated with the swing of the upper frame in the second direction to the second test position;

(c) if the raise of the boom in the third direction to the third test position, a third pump displacement command for the first pump and a boom angular velocity, each associated with the raise of the boom in the third direction to the third test position;

(d) if the dump of the bucket to the forth test position, a forth pump displacement command for the first pump and a bucket dump angular velocity, each associated with the dump of the bucket to the forth test position;

(e) if the curl of the bucket to the fifth test position, a fifth pump displacement command for the first pump and a bucket curl angular velocity, each associated with the curl of the bucket to the fifth test position; and (f) if the move of the stick, a sixth pump displacement command and a stick angular velocity associated with the move of the stick from a starting position to a sixth test position, wherein the one or more parameters includes:

(a) if the swing of the upper frame in the first direction to the first test position, a left-swing pump flow of the second pump and a swing motor flow during the swing from the starting position to the first test position;

(b) if the swing of the upper frame in the second direction to the second test position, a right-swing pump flow of the second pump and a second swing motor flow during the swing from the starting position to the second test position;

(c) if the raise of the boom, a boom-up pump flow of the first pump and a boom cylinder flow during the raise of the boom to the third test position;

(d) if the move of the stick, a stick pump flow and a stick cylinder flow during the inward or outward movement of the stick;

(e) if the dump of the bucket, a bucket-dump pump flow of the second pump and a bucket-dump cylinder flow, each associated with the bucket during the dump; or (f) if the curl of the bucket, a bucket-curl pump flow of the second pump and a bucket-curl cylinder flow, each associated with the bucket during the curl, wherein the pump volumetric efficiency and a pump status, is calculated for the first pump and the second pump.

7. The system of claim 6, in which the health test further includes:

activate stalling of movement of the stick inward toward the body;

activate stalling of dumping of the bucket;

activate stalling of swinging of the upper frame in a first direction oriented toward a left-side relative to a forward direction of travel of the excavator;

activate stalling of swinging of the upper frame in a second direction oriented toward a right-side relative to the forward direction of travel of the excavator;

activate stalling of raising of the boom;

activate stalling of movement of the stick outward from the body; or activate stalling of curling of the bucket;

in which the information received further includes:

(a) a stalled-stick-in pump pressure associated with the stalling of movement the stick inward from the body of the excavator, the stalled-stick pump pressure received from a first pressure sensor disposed on the excavator and configured to measure pressure at the output of the second pump;

(b) a stalled-left-swing pump pressure associated with the stalling of swinging of the upper frame in the first direction toward the left-side, the first stalled left-swing pump pressure received from the first pressure sensor;

(c) a stalled right-swing pump pressure associated with the stalling of swinging of the upper frame in the second direction toward the right-side, the second stalled right-swing pump pressure received from the first pressure sensor;

(d) a stalled-boom-up pump pressure associated with the stalling of raising of the boom, the stalled-boom-up pump pressure received from a second pressure sensor disposed on the excavator and configured to measure pressure at the output of the first pump;

(e) a stalled-stick-out pump pressure associated with the stalling of movement of the stick outward from the body, the stalled-stick-out pump pressure received from the first pressure sensor;

(f) a stalled-curl pump pressure associated with the stalling of the curl of the bucket, the stalled-curl pump pressure received from the second pressure sensor; or (g) a stalled-dump pump pressure associated with the stalling of the dump of the bucket, stalled-dump pump pressure received from the second pressure sensor;

determine an in-line relief valve leakage status and/or a main control valve leakage status based the comparison of the parameters to the check range or value associated with each respective parameter, wherein the parameters further include the stalled-stick-in pump pressure; the stalled-left-swing pump pressure; the stalled-right-swing pump pressure; stalled-boom-up pump pressure; the stalled-stick-out pump pressure; the stalled-curl pump pressure; and/or the stalled-dump pump pressure.

8. The system of claim 6, in which the move of the boom, stick or bucket from the starting position to the one or more test positions includes:

raise the boom to the third test position, move the stick or move the bucket to the fourth test position for dumping;

wherein the information received includes:

(d) if the raise the boom, a first boom cylinder pressure indicative of the hydraulic fluid pressure at the rod-end of the boom hydraulic cylinder when the boom is in the third test position, and a second boom cylinder pressure indicative of the hydraulic fluid pressure at the head-end of the boom hydraulic cylinder when the boom is in the third test position;

(e) if the move of the stick, a first stick cylinder pressure indicative of the hydraulic fluid pressure at the head-end of the stick hydraulic cylinder, and a second stick cylinder pressure indicative of the hydraulic fluid pressure at the rod-end of the stick hydraulic cylinder; or (f) if the dump, a first dump cylinder pressure indicative of the hydraulic fluid pressure at the rod-end of the bucket hydraulic cylinder when the bucket is in the fourth test position and a second dump cylinder pressure indicative of the hydraulic fluid pressure at the head-end of the bucket hydraulic cylinder when the bucket is in the fourth test position, wherein the one or more parameters further include first and second boom cylinder pressures, first and second stick cylinder pressures or first and second dump cylinder pressures;

determine:

(d) the cylinder leak status for the boom hydraulic cylinder based on the first and/or second boom cylinder pressures;

(e) the cylinder leak status for the stick hydraulic cylinder based on the first and/or second stick cylinder pressures; or (f) the cylinder leak status for the bucket hydraulic cylinder based on the first and/or second bucket cylinder pressures.

9. A system for a machine that includes a pivotable upper frame, a hydraulic system and an attachment, the attachment including a boom, a stick or a bucket, the system comprising a controller configured to:

receive a request to determine a health status of the hydraulic system, the hydraulic system including a plurality of components, the components including a plurality of pumps, a plurality of hydraulic cylinders, and a plurality of valves, at least one of the plurality of hydraulic cylinders configured to actuate movement of the attachment, at least one of the pumps in fluid communication with a swing motor;

in response to the request, automatically conduct a health test and determine the health status, the health test including: move the attachment or the upper frame from a starting position to one or more test positions, wherein the move includes swing the upper frame, raise the boom, move the stick inward or outward, or dump or curl the bucket;

receive information indicative of one or more measurements associated with the move of the attachment or the upper frame;

determine from the information one or more parameters, the one or more parameters including a pump flow and a swing motor flow during the swing, a boom-up pump flow and a boom cylinder flow during the raise of the boom, a stick pump flow and a stick cylinder flow during the move of the stick, a bucket-dump pump flow and a bucket-dump cylinder flow during the dump, or a bucket-curl pump flow and a bucket-curl cylinder flow during the curl;

compare each parameter to a check range or a value;

determine for a first component of the plurality a pump volumetric efficiency, a pump status, a main control valve leakage status, or an in-line relief valve leakage status; and if the pump status, the main control valve leakage status, the in-line relief valve leakage status associated with the first component is currently failing, predicted to fail or out of specification, identify the first component as a service-needed on a display or log and activate an alarm.

10. The system of claim 9 in which the one or more plurality of pumps includes a first pump and a second pump, the second pump in fluid communication with the swing motor, wherein the one or more parameters are includes:

the pump flow of the second pump during the swing of the upper frame and the swing motor flow during the swing of the upper frame, wherein the pump flow is from the second pump.

11. The system of claim 9 in which the hydraulic system includes a first pump and a second pump, in which:

(a) the swing of the upper frame includes a swinging of the upper frame in a first direction from the starting position to a first test position, the first direction oriented toward a left-side relative to a forward direction of travel of the machine;

(b) the swing the upper frame includes the swinging of the upper frame in a second direction from the starting position to a second test position, the second direction oriented toward a right-side relative to the forward direction of travel of machine;

(c) the raise of the boom includes a raising of the boom in a third direction from the starting position to a third test position, the third direction oriented upward from the starting position;

(d) the dump of the bucket includes a moving of the bucket from the starting position to a fourth test position;

(e) the curl of the bucket includes by the moving of the bucket from the starting position to a fifth test position; or (f) the move of the stick includes a movement of the stick from the starting position to a sixth test position; and wherein the information received includes:

(a) a first pump displacement command and data indicative of a first swing angle, each associated with the swing in the first direction to the first test position;

(b) a second pump displacement command, and data indicative of a second swing angle, each associated with the swing in the second direction to the second test position;

(c) a third pump displacement command and a boom angular velocity, each associated with the raise of the boom in the third direction to the third test position;

(d) a forth pump displacement command and a bucket dump angular velocity, each associated with the dump of the bucket to the forth test position;

(e) a fifth pump displacement command and a bucket curl angular velocity, each associated with the curl of the bucket to the fifth test position; or (f) a sixth pump displacement command and a stick angular velocity, wherein:

(a) the pump flow is a left-swing pump flow and the swing motor flow is a first swing motor flow during the swing of the upper frame from the starting position to the first test position; or (b) the pump flow is a right-swing pump flow and the swing motor flow is a second swing motor flow during the swing of the upper frame from the starting position to the second test position, wherein the pump volumetric efficiency and a pump status, is calculated for the first pump and/or the second pump.

12. The system of claim 9 in which the health test further includes:

activate stalling: of the stick, of dumping of the bucket, of swinging of the upper frame, of raising of the boom or of curling of the bucket; and wherein the in-line relief valve leakage status and/or the main control valve leakage status is determined based a comparison of the one or more parameters to the check range or value, wherein the parameters further include a pump pressure and a hydraulic cylinder head end pressure associated with stalling of the stick, stalling of the boom or stalling of the bucket.

13. The system of claim 9, in which the health test further includes:

activate stalling of movement of the stick inward toward the body of the machine;

activate stalling of dumping of the bucket;

activate stalling of swinging of the upper frame in a first direction oriented toward a left-side relative to a forward direction of travel of the machine;

activate stalling of swinging of the upper frame in a second direction oriented toward a right-side relative to the forward direction of travel of machine;

activate stalling of movement of the boom;

activate stalling of moving the stick outward from the body of the machine; or activate stalling of curling of the bucket;

in which the information received includes:

(a) a stalled-stick-in pump pressure associated with the stalling of the stick;

(b) a stalled-left-swing pump pressure associated with the stalling of swinging in the first direction toward the left-side;

(c) a stalled-right-swing pump pressure associated with the stalling of swinging of the upper frame in the second direction toward the right-side;

(d) a stalled-boom-up pump pressure associated with the stalling of the boom;

(e) a stalled-stick-out pump pressure associated with the stalling of movement of the stick outward from the body;

(f) a stalled-stick-in pump pressure associated with the stalling of movement of the stick inward to the body;

(g) a stalled-curl pump pressure associated with the stalling of the curling of the bucket; or (h) a stalled-dump pump pressure associated with the stalling of the dumping of the bucket;

the controller further configured to determine the in-line relief valve leakage status and/or the main control valve leakage status based a comparison of the one or more parameters to the check range or value associated with each respective parameter, wherein the parameters further include: the stalled-stick-in pump pressure; the stalled-left-swing pump pressure; the stalled-right-swing pump pressure; stalled-boom-up pump pressure; the stalled-stick-out pump pressure; the stalled-stick-in pump pressure; the stalled-curl pump pressure; or the stalled-dump pump pressure.

14. The system of claim 9, the controller further configured to determine the cylinder drift status for a boom hydraulic cylinder, stick hydraulic cylinder or bucket hydraulic cylinder based at least in part on hydraulic cylinder length of the boom hydraulic cylinder, stick hydraulic cylinder or bucket hydraulic cylinder for which the cylinder drift status is determined.

15. The system of claim 9, wherein the information received includes:

(a) data indicative of a boom hydraulic cylinder length when the boom is in a first test position, the boom hydraulic cylinder coupled to the boom and configured to actuate movement of the boom to the first test position;

(b) data indicative of a stick hydraulic cylinder length when the stick is in a second test position, the stick hydraulic cylinder coupled to the stick and configured to actuate movement of the stick to the second test position;

(c) data indicative of a first bucket hydraulic cylinder length when the bucket is in a third test position, the bucket hydraulic cylinder coupled to the bucket and configured to actuate dumping movement of the bucket to the third test position; and (d) data indicative of the first bucket hydraulic cylinder length when the bucket is in a fourth test position, the first bucket hydraulic cylinder further configured to actuate curling movement of the bucket to the fourth test position;

wherein the one or more parameters further include: boom hydraulic cylinder length, stick hydraulic cylinder length, bucket dump cylinder length, or bucket curl cylinder length; and the controller further configured to determine:

(a) a cylinder drift status for the boom hydraulic cylinder based on boom hydraulic cylinder length;

(b) a cylinder drift status for the stick hydraulic cylinder based on stick hydraulic cylinder length;

(c) a bucket dump drift status for the bucket hydraulic cylinder based on bucket dump cylinder length; or (d) a bucket curl drift status for the bucket hydraulic cylinder based on bucket curl cylinder length; and the controller further configured to identify as service-needed on the display or the log and activate the alarm for:

(a) the boom hydraulic cylinder, if the cylinder drift status for the boom hydraulic cylinder is currently failing, predicted to fail or out of specification;

(b) the stick hydraulic cylinder, if the cylinder drift status for the stick hydraulic cylinder is currently failing, predicted to fail or out of specification; or (c) the bucket hydraulic cylinder, if the bucket dump drift status or the bucket curl drift status for the bucket hydraulic cylinder is currently failing, predicted to fail or out of specification.

16. The system of claim 9, wherein the information received includes:

(a) one or more boom cylinder pressures indicative of the hydraulic fluid pressure at a rod-end and/or head end of a boom hydraulic cylinder when the boom is raised to a first test position;

(b) one or more stick cylinder pressures indicative of the hydraulic fluid pressure at a head-end and/or rod-end of a stick hydraulic cylinder when the stick is moved to a second test position; or (c) one or more dump cylinder pressures indicative of the hydraulic fluid pressure at a rod-end and/or head-end of a bucket hydraulic cylinder when the bucket is moved to a third test position;

wherein the one or more parameters further include boom cylinder pressure at the head-end and/or rod-end, stick cylinder pressure at the head-end and/or rod-end or dump cylinder pressure at the head-end and/or rod-end;

the controller further configured to determine:

(a) a cylinder seal leak status for the boom hydraulic cylinder based on the boom cylinder pressure measured at the head-end and/or rod-end of the boom hydraulic cylinder;

(b) a cylinder seal leak status for the stick hydraulic cylinder based on the stick cylinder pressure measured at the head-end and/or rod-end of the stick hydraulic cylinder; or (c) a cylinder seal leak status for the bucket hydraulic cylinder based on the bucket cylinder pressure measured at the head-end and/or rod-end of the bucket hydraulic cylinder; and the controller further configured to identify as service-needed on the display or the log and activate the alarm for:

(a) the boom hydraulic cylinder, if the cylinder seal leak status for the boom hydraulic cylinder is currently failing, predicted to fail or out of specification;

(b) the stick hydraulic cylinder, if the cylinder seal leak status for the stick hydraulic cylinder is currently failing, predicted to fail or out of specification; or (c) the bucket hydraulic cylinder, if the cylinder seal leak status for the bucket hydraulic cylinder is currently failing, predicted to fail or out of specification.

17. The system of claim 9, in which the controller is further configured to activate emission or display of an audible alarm, an alert or a visual warning by an output member associated with the machine when a component is identified as a service-needed.

18. The method of claim 17, wherein a hydraulic fluid in the hydraulic system is above a temperature threshold.

* * * * *